US011092401B2

(12) United States Patent
Kubiniec

(10) Patent No.: US 11,092,401 B2
(45) Date of Patent: Aug. 17, 2021

(54) UPPER SADDLE TO SECURE THE BARREL OF A WEAPON FOR WEAPON STORAGE

(71) Applicant: Thomas Kubiniec, Cazenovia, NY (US)

(72) Inventor: Thomas Kubiniec, Cazenovia, NY (US)

( * ) Notice: Subject to any disclaimer, the term of this patent is extended or adjusted under 35 U.S.C. 154(b) by 0 days.

(21) Appl. No.: 16/426,268

(22) Filed: May 30, 2019

(65) Prior Publication Data

US 2020/0378712 A1 Dec. 3, 2020

(51) Int. Cl.
*F41A 23/18* (2006.01)
*A47B 81/00* (2006.01)

(52) U.S. Cl.
CPC ..... *F41A 23/18* (2013.01); *A47B 81/005* (2013.01)

(58) Field of Classification Search
CPC ..... F41A 23/18; A47B 81/005; A47L 13/512; A47F 7/0028; A47F 7/0021; B60R 7/14
USPC ..... 211/60.1, 64
See application file for complete search history.

(56) References Cited

U.S. PATENT DOCUMENTS 121,458 A * 12/1871 Groff ..... A47L 13/512 248/113
198,714 A * 12/1877 Uibel ..... A47L 13/512 248/113
353,716 A * 12/1886 Spencer ..... A47K 1/09 211/65
380,320 A * 4/1888 Gash ..... A47L 13/512 248/113
554,252 A 2/1896 Falk
958,570 A * 5/1910 Watson ..... A47L 13/512 248/113
1,117,491 A * 11/1914 Hornung ..... A47G 25/12 211/63
1,552,252 A * 9/1925 Webb ..... A47L 13/512 248/113
1,798,028 A * 3/1931 Nachtigal ..... A47L 13/512 248/113
1,911,781 A * 5/1933 Wolfe, Jr. ..... A47L 13/512 248/113
1,925,767 A * 9/1933 Mallory ..... A47L 13/512 248/113
2,379,060 A * 6/1945 Bacheldor ..... A47L 13/512 248/113
2,783,896 A * 3/1957 Agostini ..... B60R 7/14 211/64

(Continued)

OTHER PUBLICATIONS

Spacesaver, Installation Instructions for Universal Weapons Rack, pp. 1-32, Jun. 2010, www.spacesaver.com/Universal_Weapons_Rack.htm.

(Continued)

*Primary Examiner* — Patrick D Hawn
(74) *Attorney, Agent, or Firm* — Harris Beach PLLC

(57) ABSTRACT

An upper saddle of a weapon storage rack for securing a barrel of a firearm includes an upper saddle body with an about U-shaped opening adapted to accept the barrel of the firearm. A pair of snap locks is disposed in or on the upper saddle, the pair of snap locks includes a left snap lock and a right snap lock. The pair of snap locks includes a pair of rollers or a rotating locks spring biased by a spring or a band to at least a spring biased open or a spring biased closed position.

13 Claims, 24 Drawing Sheets

(56) References Cited

U.S. PATENT DOCUMENTS 2,807,431 A * 9/1957 McHale ..... B44D 3/123 248/113
3,361,265 A * 1/1968 Wernimont ..... A47F 7/0028 211/64
3,589,523 A * 6/1971 Belden ..... B42F 17/02 211/51
3,832,796 A * 9/1974 Cardwell ..... A01K 97/10 43/25
4,132,315 A * 1/1979 Young ..... E05B 73/00 211/4
4,639,036 A * 1/1987 Nichols ..... A47C 7/62 248/230.2
4,705,177 A * 11/1987 Oren ..... A63C 11/028 211/70.5
4,936,531 A 6/1990 Bauser
4,986,427 A 1/1991 Law et al.
5,322,256 A * 6/1994 Kanwischer ..... A47L 13/512 211/65
5,794,799 A 8/1998 Collins et al.
5,979,846 A 11/1999 Fluhr
5,992,811 A * 11/1999 McFerren ..... A01D 34/001 248/113
6,565,053 B1 * 5/2003 Larky ..... A61G 5/10 211/62
6,595,376 B1 * 7/2003 Lin ..... A47L 13/512 211/66
7,051,471 B1 * 5/2006 Ausborne, Jr. ..... A01K 97/06 206/315.11
7,100,808 B2 * 9/2006 Hancock ..... F16L 3/10 224/547
7,185,796 B2 * 3/2007 Parsons ..... A45F 5/02 224/197
D611,558 S * 3/2010 Freeman ..... D22/108
7,770,740 B2 * 8/2010 Punzel ..... A47B 81/005 211/64
D701,584 S 3/2014 Kasbohm
8,678,206 B2 * 3/2014 Kubiniec ..... A47B 81/005 211/64
D705,045 S * 5/2014 Lønner ..... D8/380
8,950,596 B2 2/2015 Arabian et al.
9,095,975 B2 * 8/2015 Green ..... A47L 13/512
9,314,918 B2 * 4/2016 Wilbs ..... A47L 13/512
9,345,323 B1 * 5/2016 Kubiniec ..... A47B 81/005
9,565,935 B2 * 2/2017 Kubiniec ..... A47B 81/005
9,708,835 B2 * 7/2017 Fisher ..... E05B 73/00
10,125,919 B2 * 11/2018 Forsberg ..... B25H 3/00
10,144,358 B2 * 12/2018 Fife ..... B60R 7/14
10,260,832 B2 * 4/2019 Bowe, Jr. ..... F41A 23/18
10,576,900 B2 * 3/2020 Bornais ..... B60R 7/14
2005/0145585 A1 * 7/2005 Pintar ..... A47F 7/0028 211/64
2005/0167378 A1 * 8/2005 Scott, Jr. ..... A47B 81/005 211/64
2005/0178936 A1 * 8/2005 Chen ..... B25H 3/04 248/230.1
2006/0027473 A1 * 2/2006 Taylor ..... F41C 33/06 206/315.11
2008/0000853 A1 * 1/2008 Huang ..... A47F 7/0028 211/70.6
2011/0114580 A1 * 5/2011 Chen ..... B25H 3/04 211/70.6
2012/0193254 A1 * 8/2012 Kubiniec ..... A47B 96/027 206/317
2013/0269509 A1 * 10/2013 Irwin ..... F41A 23/18 89/37.01
2014/0305175 A1 * 10/2014 Irwin ..... F41C 33/06 70/14
2015/0001367 A1 * 1/2015 Green ..... B25H 3/04 248/539
2016/0120308 A1 * 5/2016 Kubiniec ..... A47B 96/027 211/64
2016/0213144 A1 * 7/2016 Kubiniec ..... A47F 7/0035
2017/0030114 A1 * 2/2017 Fisher ..... E05B 73/00
2018/0009362 A1 * 1/2018 Abohammdan ..... B60R 7/08
2018/0094892 A1 * 4/2018 Bowe, Jr. ..... F41A 23/18

OTHER PUBLICATIONS

Marvel, Design Drawing for Part No. WRBSXW, Sheet 1 of 1, Apr. 2007, www.universalweaponracks.com/pdfs/new/WRBSXW.PDF.
Marvel, Design Drawing for Part No. MWRM4/16/500M249, Sheet 1 of 1, Jul. 2008, www.universalweaponracks.com/pdfs/new/MWRM4-16-500M249a.PDF.
US Army, PS Magazine PS 639, Feb. 2006, pp. 1-2, https://www.logsa.army.mil/psmag/pshome.cfm.

* cited by examiner

UPPER SADDLE TO SECURE THE BARREL OF A WEAPON FOR WEAPON STORAGE

FIELD OF THE APPLICATION

The application relates to weapons storage, particularly to upper saddles to secure the barrel of a weapon.

BACKGROUND

Weapon storage systems typically include a lower saddle to accept the butt end of a firearm and an upper saddle to secure the barrel of the weapon.

SUMMARY

An upper saddle of a weapon storage rack for securing a barrel of a firearm includes an upper saddle body with a generally U-shaped opening adapted to accept the barrel of the firearm. A pair of snap locks is disposed in or on the upper saddle. The pair of snap locks includes a left snap lock and a right snap lock. The pair of snap locks includes a pair of rollers or a rotating locks spring biased by a spring or a band to at least a spring biased open or a spring biased closed position.

The upper saddle can include a wireform spring.

The upper saddle can include a first configuration where without the barrel disposed in the upper saddle body, or with the barrel snapped in, a distance between a right most extent of the left snap lock and a left most extent of the right snap lock is less than a diameter of the barrel of the firearm to be secured in a weapon rack.

Each roller can be rotatingly coupled to a pin which extends from an end of a spring element which spring element spring biases both of the rollers to the first configuration.

The distance between a right most extent of the left snap lock and a left most extent of the right snap lock is equal to or greater than the barrel of the firearm as the barrel passes into an upper saddle barrel locked state.

Each roller can be rotatingly coupled to a pin which extends from an end of a spring element which spring element spring biases both of the rollers towards a barrel capture position.

The spring element can be secured to a top surface of the upper saddle body.

The spring element can include a wire spring secured to the upper saddle body by at least one cleat.

The spring element can include a wire spring secured to the upper saddle body by a center T cleat and a left and a right L cleat.

The upper saddle body can include a first surface having about the generally U-shaped opening and a second surface having about the generally U-shaped opening and a back surface.

The pair of rollers can be disposed between a first surface and a second surface of the upper saddle.

The spring element can be mechanically coupled to a back surface of the upper saddle.

The pair of rotating locks can be mechanically coupled together by an elastic element.

Without the barrel snapped in, the elastic element spring can bias each of the rotational locks into a rotational position so that a distance between a right most extent of the left snap lock and a left most extent of the right snap lock is equal to or greater than a diameter of the barrel of the firearm to be secured in a weapon rack.

With the barrel snapped in, a distance between a right most extent of the left snap lock and a left most extent of the right snap lock is less than a diameter of the barrel of the firearm to be secured in a weapon rack.

A combination of a cam action and the elastic element can cause the pair of rotating locks to spring bias towards a barrel capture position.

The upper saddle body can include a first surface having about the generally U-shaped opening and a second surface having about the generally U-shaped opening and the pair of rotating locks are mechanically coupled together by the elastic element are disposed between the first surface and the second surface.

The elastic element can include an elastic band.

Each of the pair of rotating locks can include three walls disposed in about a triangular shape or four walls disposed in about a rectangular or parallelogram shape.

Each of the pair of rotating locks can include at least one outer surface feature selected from the group consisting of, ridges, lines, grooves, troughs, dimples, and any combination thereof.

The foregoing and other aspects, features, and advantages of the application will become more apparent from the following description and from the claims.

BRIEF DESCRIPTION OF THE DRAWINGS

The features of the application can be better understood with reference to the drawings described below, and the claims. The drawings are not necessarily to scale, emphasis instead generally being placed upon illustrating the principles described herein. In the drawings, like numerals are used to indicate like parts throughout the various views.

DETAILED DESCRIPTION

Figure 1:
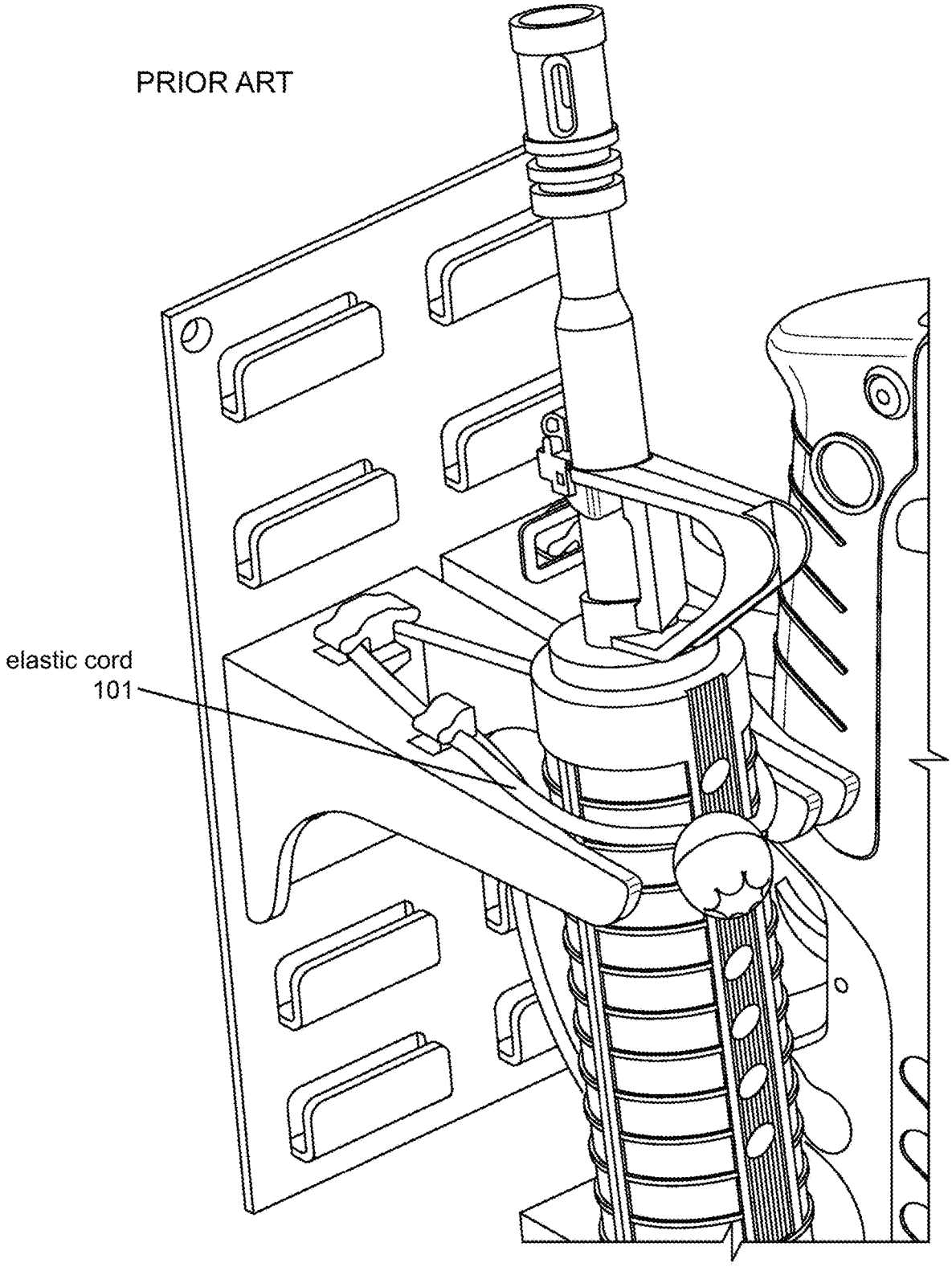
FIG. 1 is a drawing showing a barrel secured to an upper saddle of a weapon storage system of the prior art by an elastic cord.

Weapon storage systems typically include a lower saddle to accept the butt end of a firearm and an upper saddle to secure the barrel of the firearm. U.S. Pat. No. 9,345,323, REVISED MASS WEAPON STORAGE SYSTEM, also assigned to SecureIt, describes one such system. FIG. 1 shows FIG. 14 of the '323 patent where the barrel can be held in the upper saddle by an elastic cord 101. There is a need for still further improved structures to secure the barrel of a firearm into an upper saddle, while allowing for relatively fast insertion and removal of the weapon. There is also a need for improved structures to secure the barrel of relatively heavy high caliber barrels, such as, for example, those of machine guns, into an upper saddle.

It was realized that a capture structure of opposing snap locks solves both problems, speed of access to the weapon, and secure hold of the barrel, including heavier weapons, in the upper saddle when the barrel of the weapon is placed in the upper saddle. Using a snap lock structure (e.g. a pair of rollers or a pair of rotating locks) a snap action is achieved where when the barrel is pressed into an opening of the upper saddle, the barrel snaps and locks securely into place in the upper saddle.

In one embodiment suitable for all types of weapons, and particularly suitable for relatively large barrels, two opposing rollers mechanically mounted on or in the upper saddle, are spring biased towards each other by a pair of spring arms. Both rollers are disposed about in a plane which is about perpendicular to the longitudinal direction of a barrel inserted into the upper saddle. When loading a weapon into the weapon storage system, typically the butt end is inserted into a lower saddle or the floor of the storage compartment, and then the barrel is pressed through the opening between the opposing rollers, causing the rollers to move apart just enough to allow the barrel to pass through into an about U-shaped opening in the upper saddle. Once past the shortest distance between the pushed open pair of rollers, the spring biased arms push the rollers back towards each other, thus capturing the barrel of the weapon in a locked secured position in the upper saddle. The barrel is locked by the spring bias forcing the rollers together where the distance between the inside edges of the rollers is now less than the diameter of the barrel of the weapon.

Figure 2A:
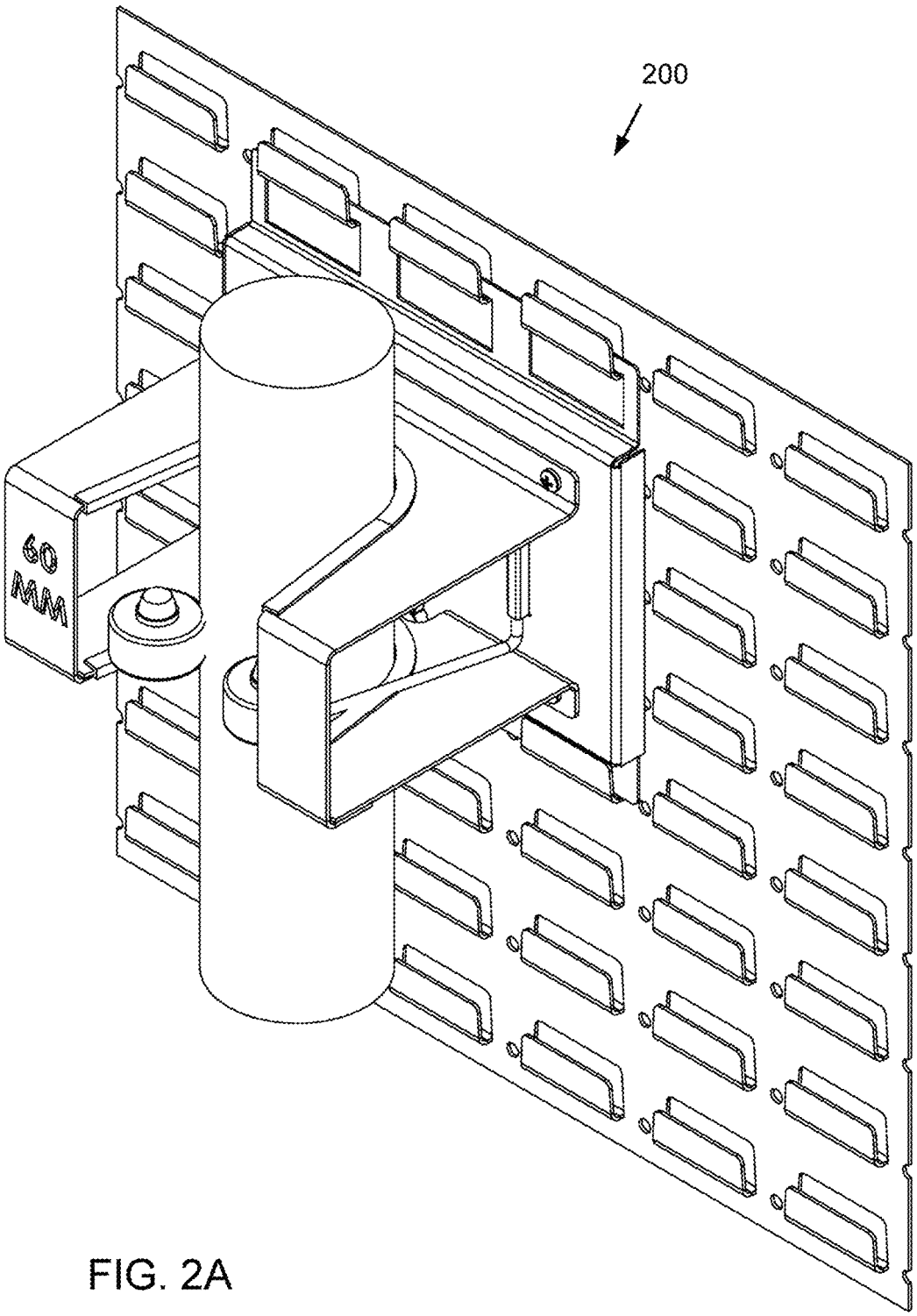
FIG. 2A is a drawing showing an isometric view of the exemplary 60 mm barrel upper saddle.

Example—60 mm barrel: FIG. 2A to FIG. 2D show drawings of an exemplary pair rollers type locking upper saddle 200. FIG. 2A shows an isometric view of the exemplary 60 mm barrel upper saddle.

Figure 2B:
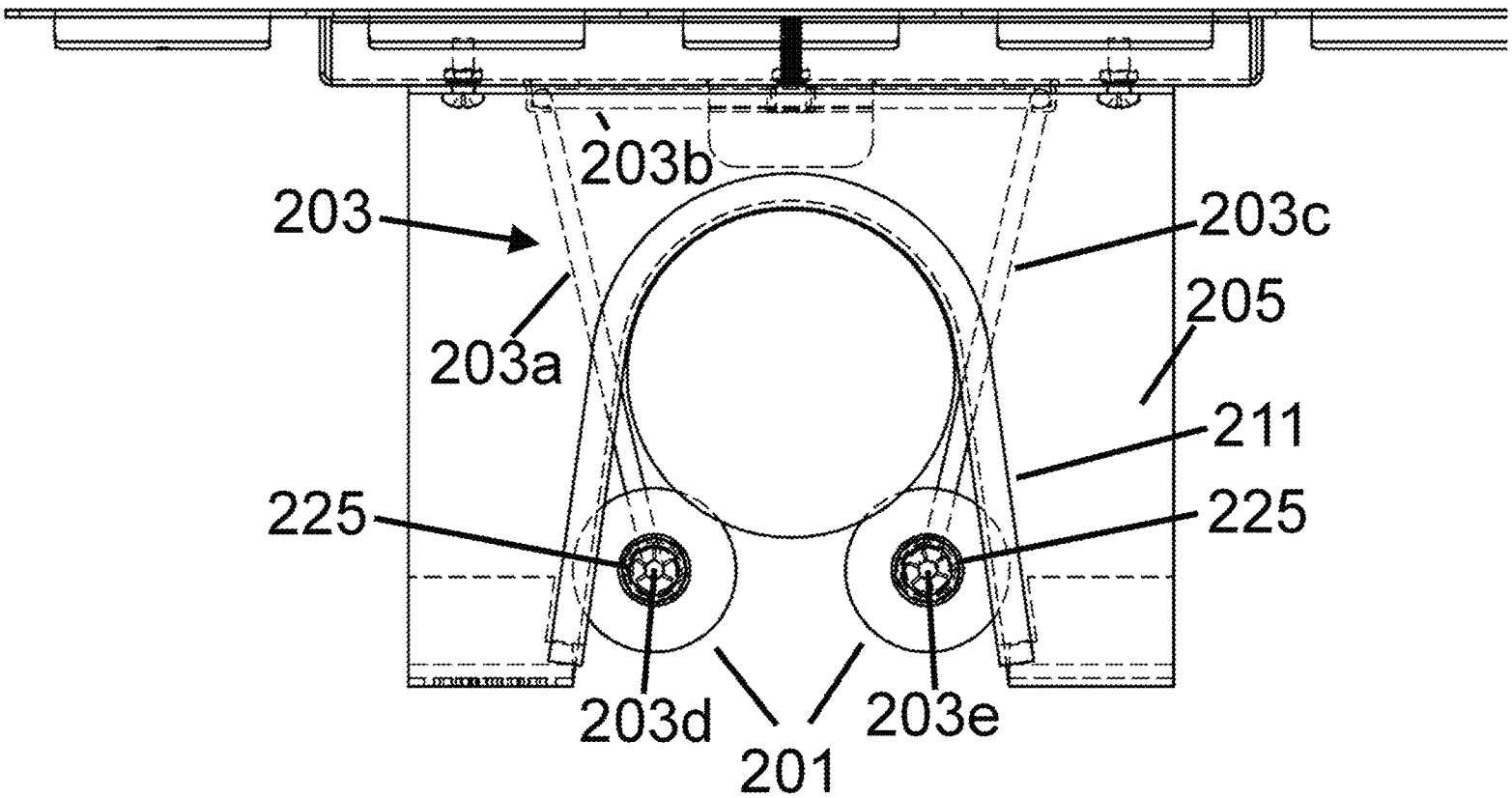
FIG. 2B is a drawing showing a top view of the roller type locking upper saddle of FIG. 2A.
Figure 2C:
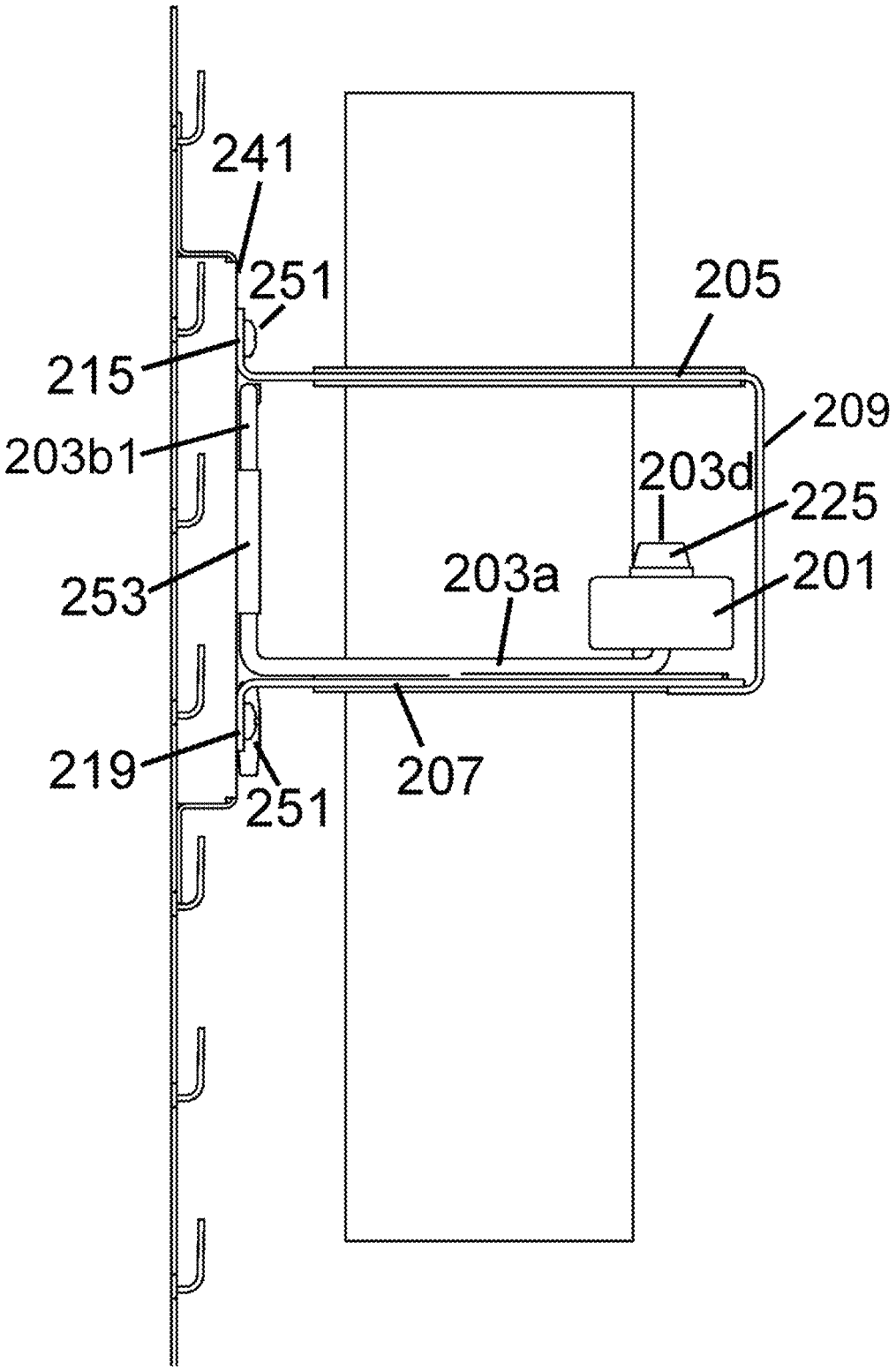
FIG. 2C is a drawing showing a side view of the roller type locking upper saddle of FIG. 2A.

FIG. 2B shows a top view of the roller type locking upper saddle of FIG. 2A. In FIG. 2B, Rollers 201 can be seen as held together by a wire spring assembly 203 which wireform includes a pair of spring arms 203*a*, 203*c* in about a common plane which is about perpendicular to the longitudinal axis of the 60 mm barrel. The upper saddle body includes a first surface 205, a second surface 207 and a front surface 209 (FIG. 2C). There is an about U-shaped opening in both of the first surface 205 and the second surface 207 (FIG. 2C). The U-shaped openings are defined by walls of the surfaces which are about equal to the thickness of the material from which the material, typically a sheet metal or molded plastic, was cut or formed in the about U-shaped pattern. Typically, there can be protective U-channels 211 placed over the edges of each of the U-shaped openings to prevent scratching or marring of the surface of the barrel.

FIG. 2C shows a side view of the roller type locking upper saddle of FIG. 2A. In this exemplary roller type locking upper saddle, the spring arms 203 and pair of rollers 201 are disposed between the first surface 205 and the second surface 207.

In FIG. 2C it can be seen that the exemplary pair of spring arms 203*a*, 203*c* (203*c* not visible in FIG. 2C) are part of one continuous spring wire assembly 203 which is mechanically mounted to a back surface 241 of the roller type locking upper saddle assembly. The exemplary back surface 241 of FIG. 2C is mechanically coupled to the first surface 205 and the second surface 209 by a first surface flange 215 and a second surface flange 219 by screws 251 inserted through screw holes in the flanges to fasten the flanges to the back surface 241.

Three legs, 203*b*1, 203*b*2, and 203*b*3 (FIG. 2E) of the wire spring assembly 203, lie against the back surface 241. Legs 203*b*1 and 203*b*3 are affixed to raised channels 253 (FIG. 2C) of the back surface 241. Extending at about right angles from the legs 203*a* and 203*c* are two spring arm shafts 203*d*, 203*e* one which roller of the pair of rollers it rotatingly mounted. The rollers 201 are held onto each of the two spring arm shafts 203*d*, 203*e* by self-locking push on retaining rings 225. The two spring arm shafts 203*d*, 203*e* are spring biased towards each other by spring wire assembly 203 legs, 203*a*, and 203*c*. For the exemplary 60 mm barrel upper saddle, the distance between the innermost surfaces of the pair or rollers varies from about 0.5 inches in a relaxed (no weapon) spring biased condition to about 2.75 inches where the barrel is passing through the rollers, either for securing the weapon in the roller type locking upper saddle of the weapon storage rack, or while removing the weapon for use.

Figure 2D:
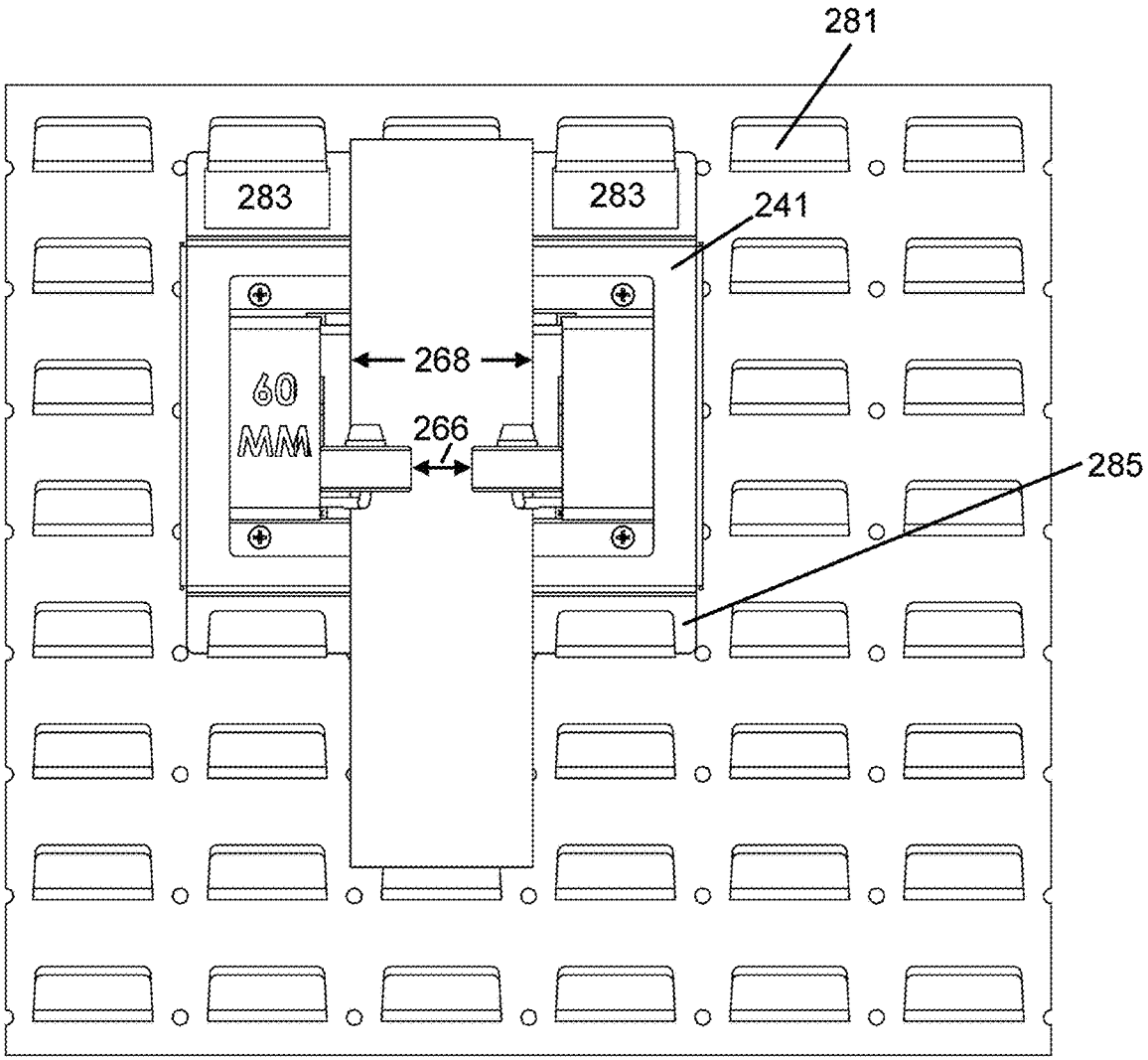
FIG. 2D is a drawing showing a front view of the roller type locking upper saddle of FIG. 2A.
Figure 2E:
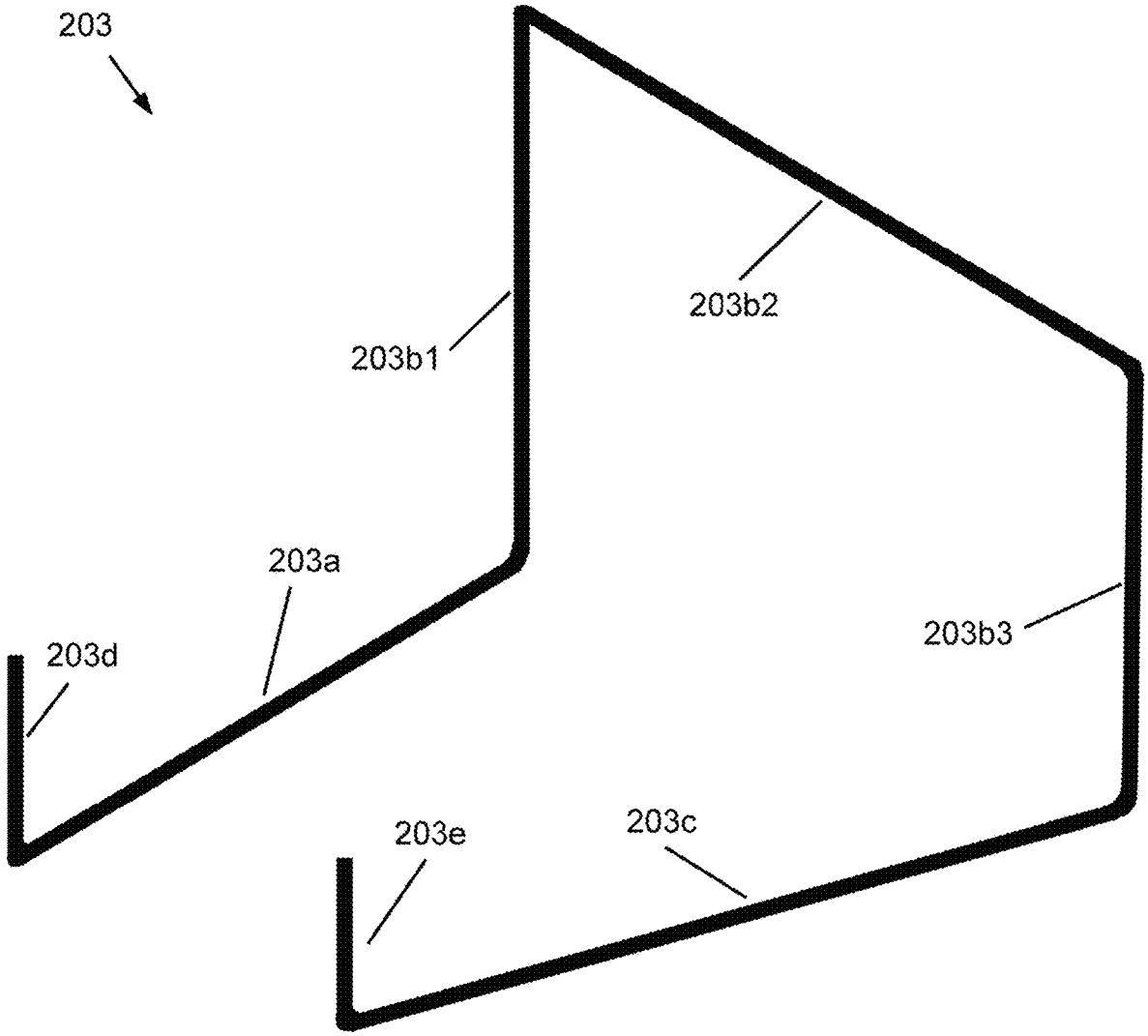
FIG. 2E is a drawing showing an exemplary wireform spring for use with the roller type locking upper saddle of FIG. 2A.

FIG. 2D shows a front view of the roller type locking upper saddle of FIG. 2A. The rollers are shown in a locked position with a locked distance 266 between the innermost edges of each of the pair rollers 201. In the locked position, the distance 266 is less than the diameter of the barrel being stowed, barrel outside diameter 268. The exemplary roller type locking upper saddle assembly 200 of FIG. 2A to FIG. 2D typically mounts to a weapon storage system by a series of hooks 281 of the storage rack sliding into corresponding hook openings 283 and lower flange 285 which extends from the back surface 241.

Example—81 mm barrel: FIG. 3A to FIG. 3D show another exemplary roller type locking upper saddle 300 similar to that of FIG. 2A to FIG. 2D.

In the case of the larger 81 mm barrel (e.g. for a M-2 0.50 caliber machine-gun type weapon), the wire spring assembly bends open at least about 6.7 degrees, the change in angle of the spring arms 203*a*, 203*b* with respect to a line about perpendicular the back surface, or about another ½ inch on both sides for the weapon to be passed through the pair of rollers and locked in place. For the exemplary roller type locking upper saddle FIG. 3A to FIG. 3D (81 mm barrel), the distance between the innermost surfaces of the pair or rollers varies from about 0.75" inches in a relaxed (no weapon) spring biased condition to about 3.125" inches where the barrel is passing through the rollers, either for securing the weapon in the roller type locking upper saddle of the weapon storage rack, or while removing the weapon for use. Those skilled in the art, will understand that these distances will vary for the types of barrels for which the upper saddle is intended.

Figure 3A:
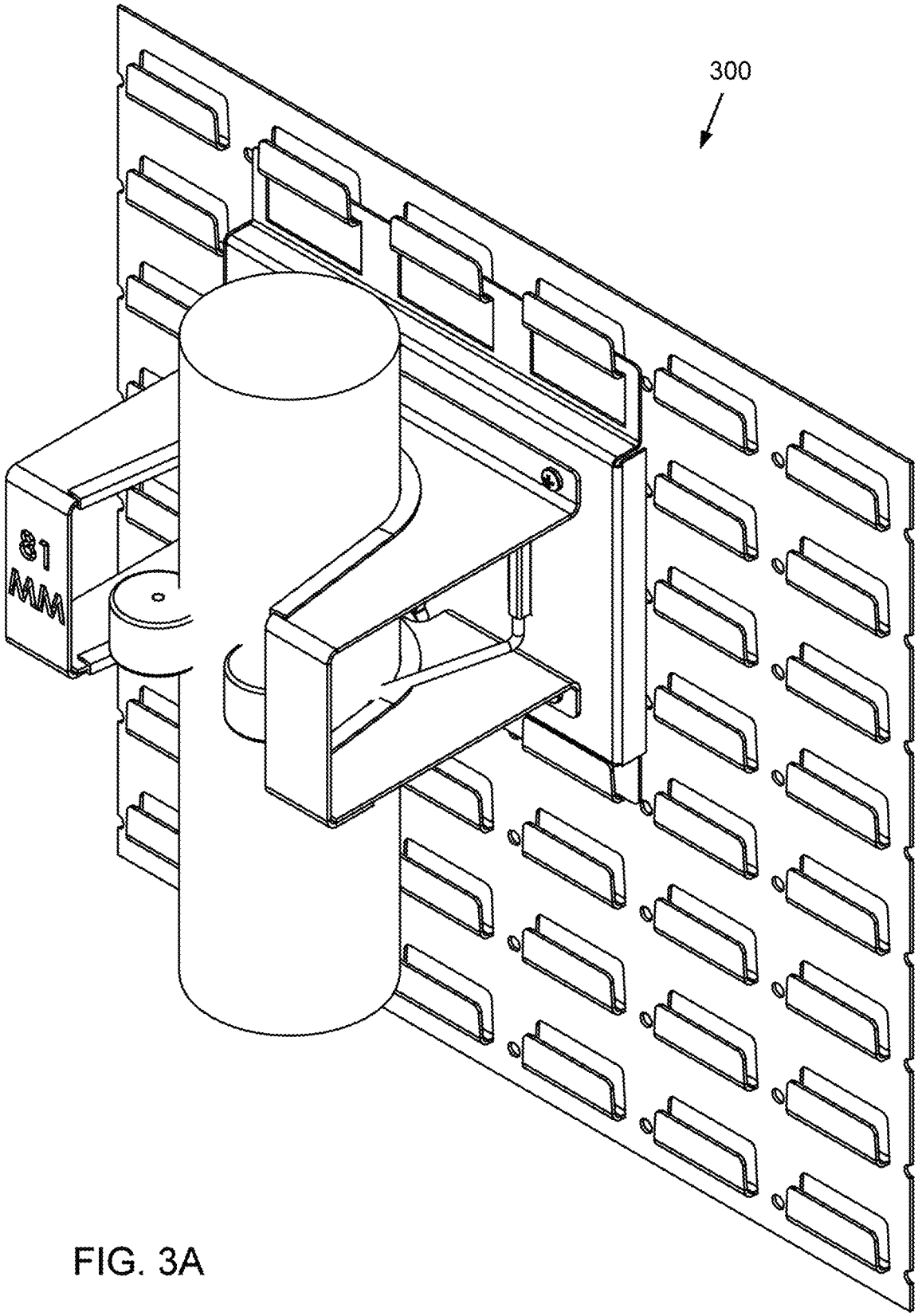
FIG. 3A is a drawing showing another exemplary roller type locking upper saddle.
Figure 3B:
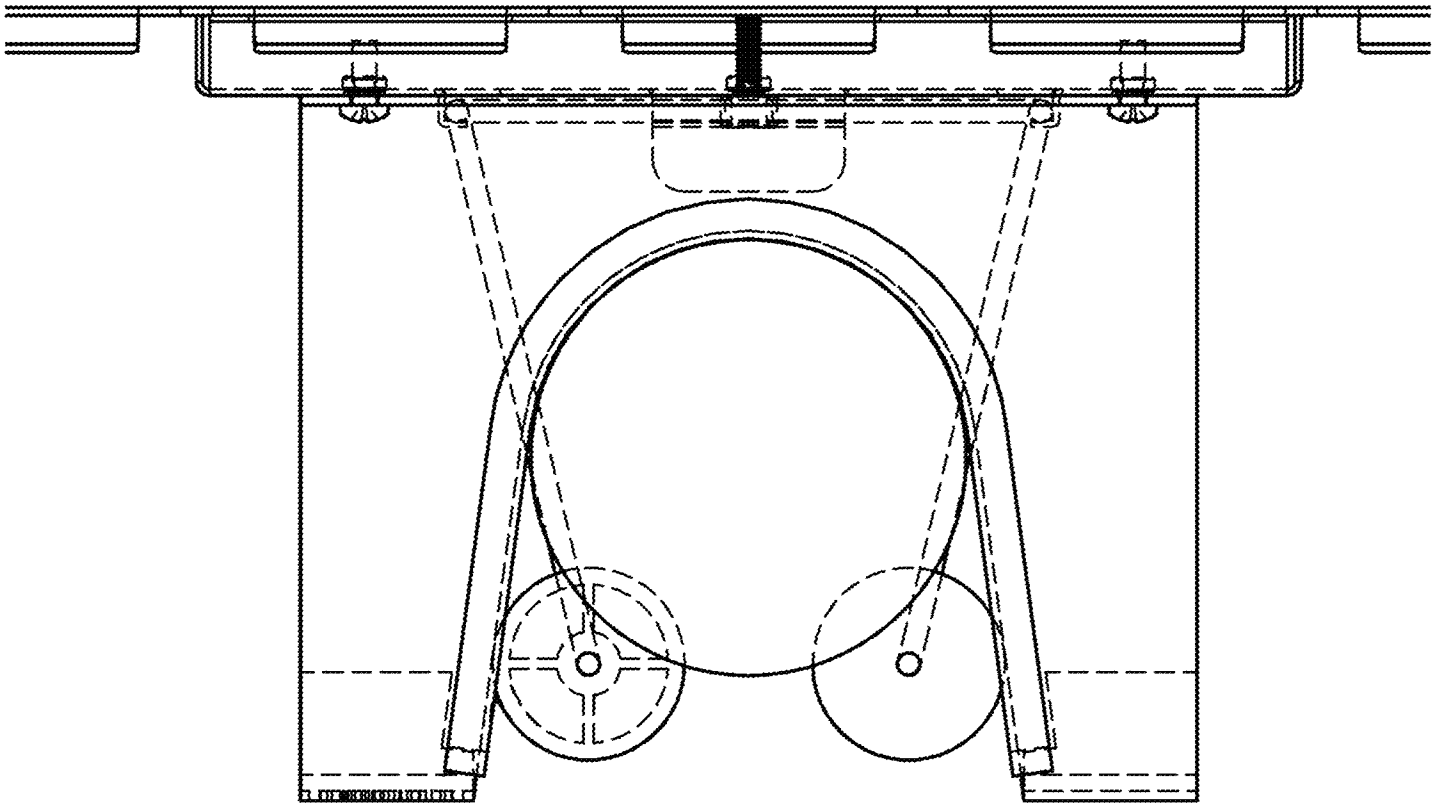
FIG. 3B is a drawing showing a top view of the roller type locking upper saddle of FIG. 3A.
Figure 3C:
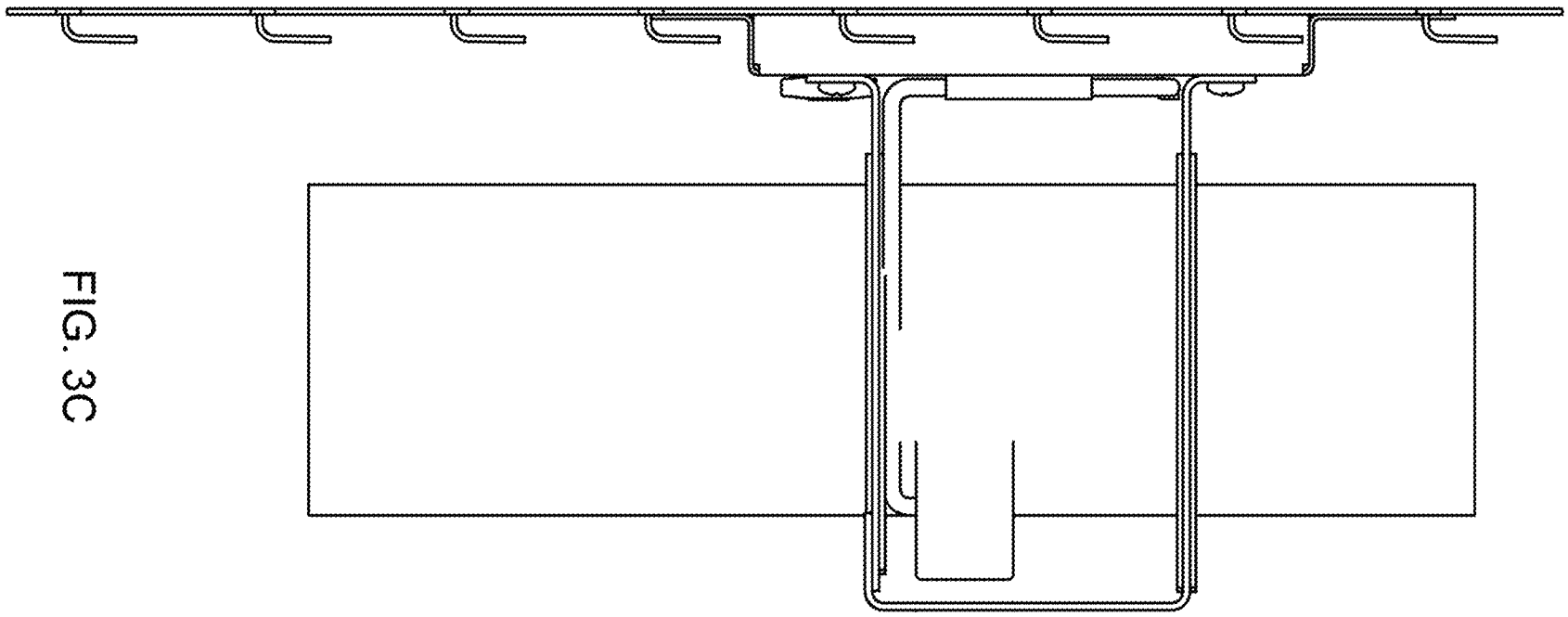
FIG. 3C is a drawing showing a side view of the roller type locking upper saddle of FIG. 3A.
Figure 3D:
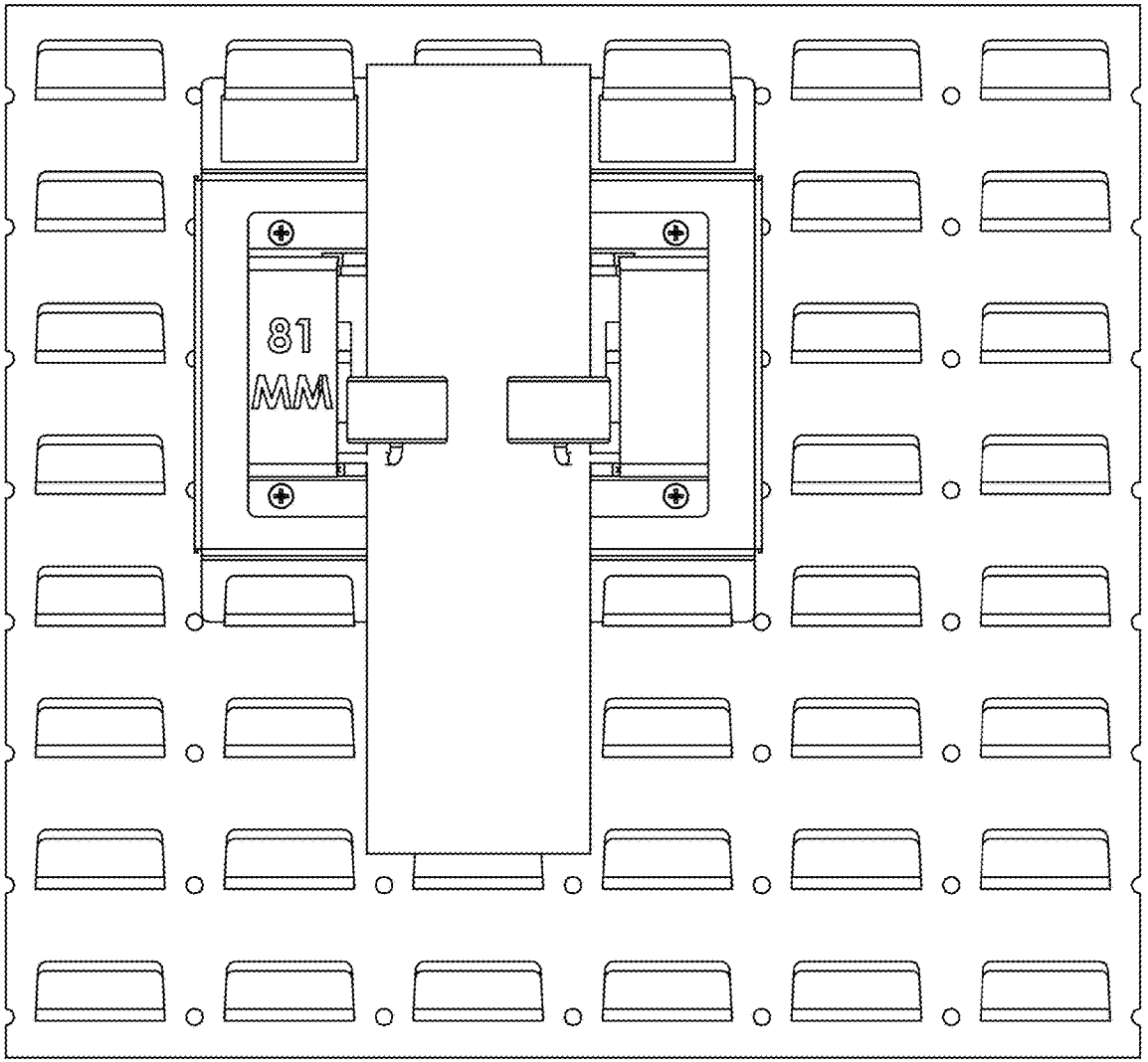
FIG. 3D is a drawing showing a front view of the roller type locking upper saddle of FIG. 3A.
Figure 3E:
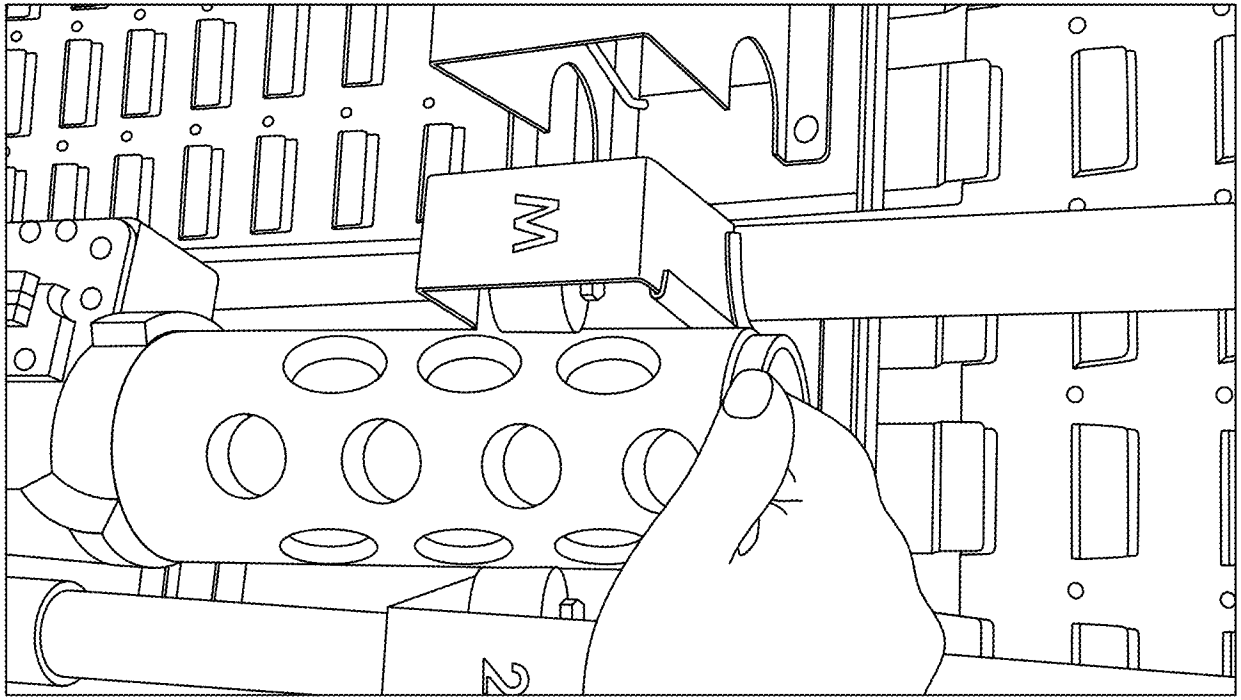
FIG. 3E is a drawing showing an M-2 barrel support being pushed into the upper saddle of FIG. 3A.
Figure 3F:
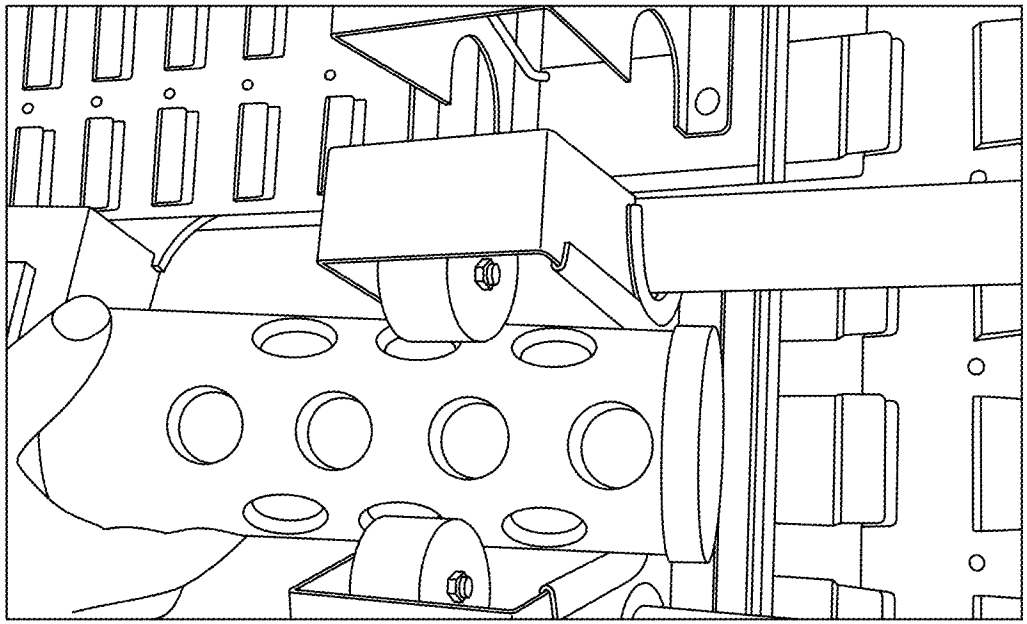
FIG. 3F is a drawing showing an M-2 barrel support secured in the upper saddle of FIG. 3A.

FIG. 3E shows a front view of the roller type locking upper saddle 300 of FIG. 3A with a M-2 barrel support moving through the rollers. FIG. 3F shows a front view of the roller type locking upper saddle of FIG. 3A with the M-2 barrel support secured in the roller type locking upper saddle 300.

Example—Large barrel weapon assembly: In the case of some larger barrel weapons (e.g. Mk-19 40 mm grenade launcher machine gun), it was realized that the weapon is best stored at an angle from the butt end the barrel end. For example, the Mk-19 40 mm grenade launcher can be secured in a weapon rack with a vertical barrel angle of at least about 7 degrees with respect to an about vertical wall of a weapon storage rack.

Figure 4:
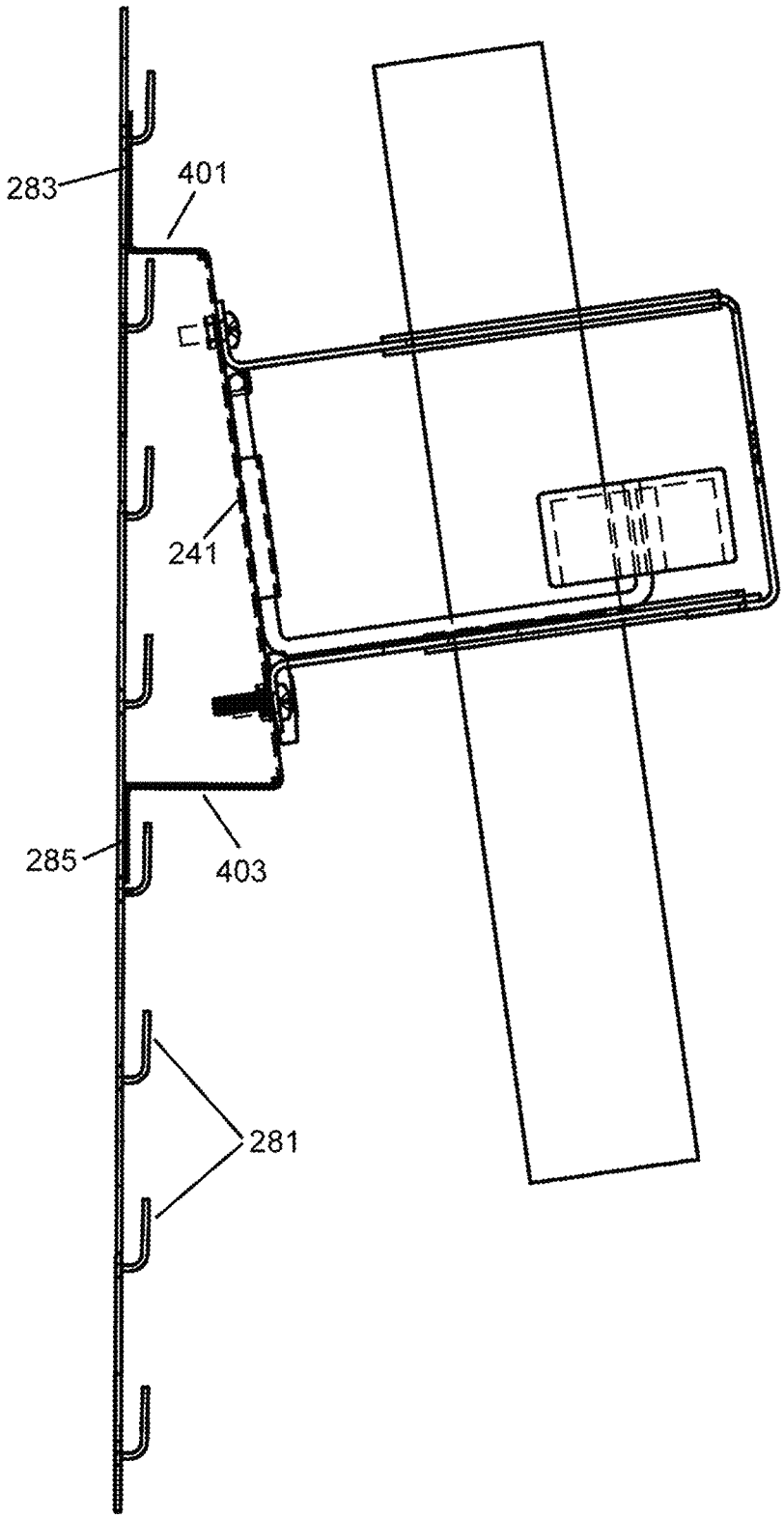
FIG. 4 is a drawing showing an exemplary roller type locking upper saddle for a Mk-19 machine grenade gun.

FIG. 4 shows an exemplary roller type locking upper saddle for the Mk-19 machine gun. The back surface 241 can be seen to have an angle of about 8.25 degrees to the back hooked wall of the storage cabinet. The angle of the upper saddle is achieved by use of two different heights of flange walls 401, 403, while the flanges are bent so that the openings 283 and lower flange 285 which extends from the back surface 241 are in about the plane of the back of the back surface 241. Openings 283 and lower flange 285 engage hooks 281 of a wall of a storage cabinet as before hereinabove in FIG. 2D.

Figure 5A:
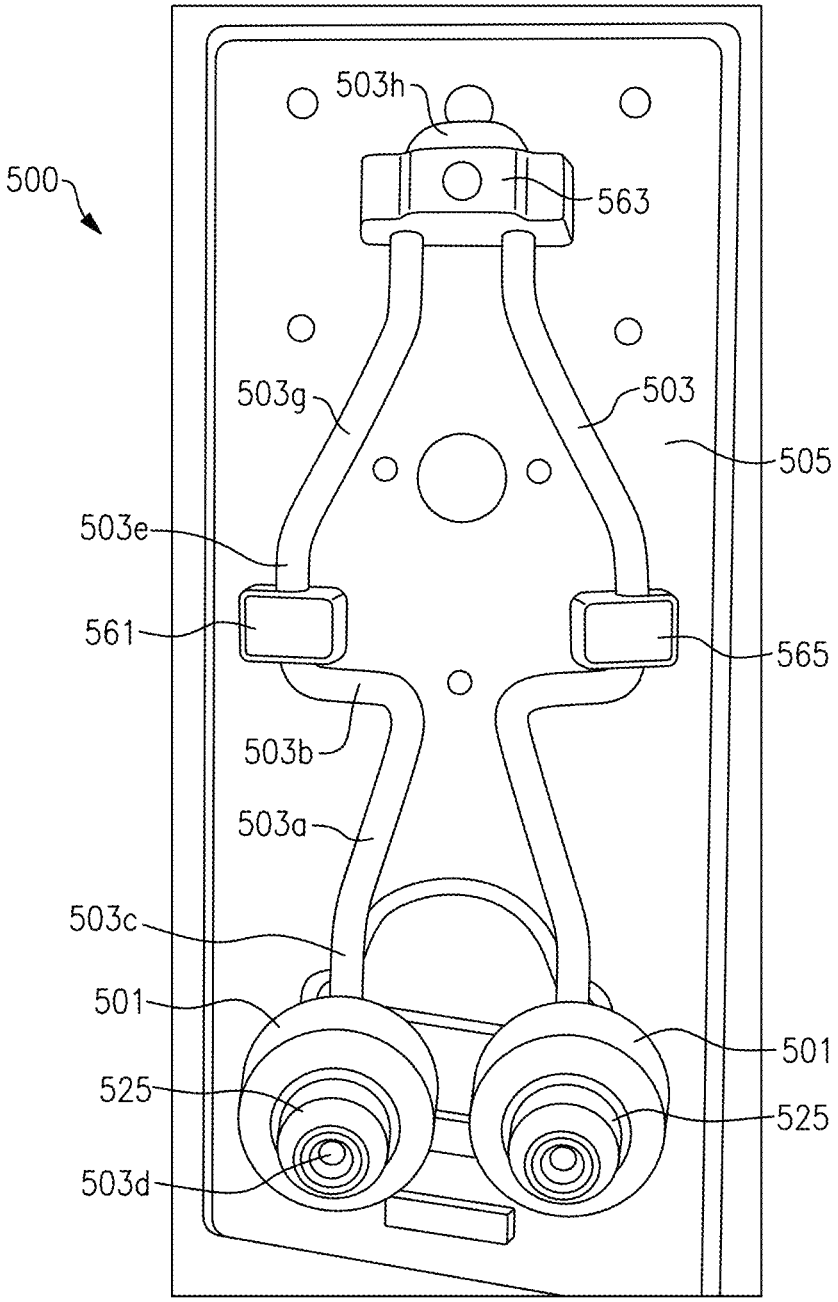
FIG. 5A is a drawing showing a top view of an exemplary roller type locking upper saddle to secure a rifle barrel for weapon storage.
Figure 5B:
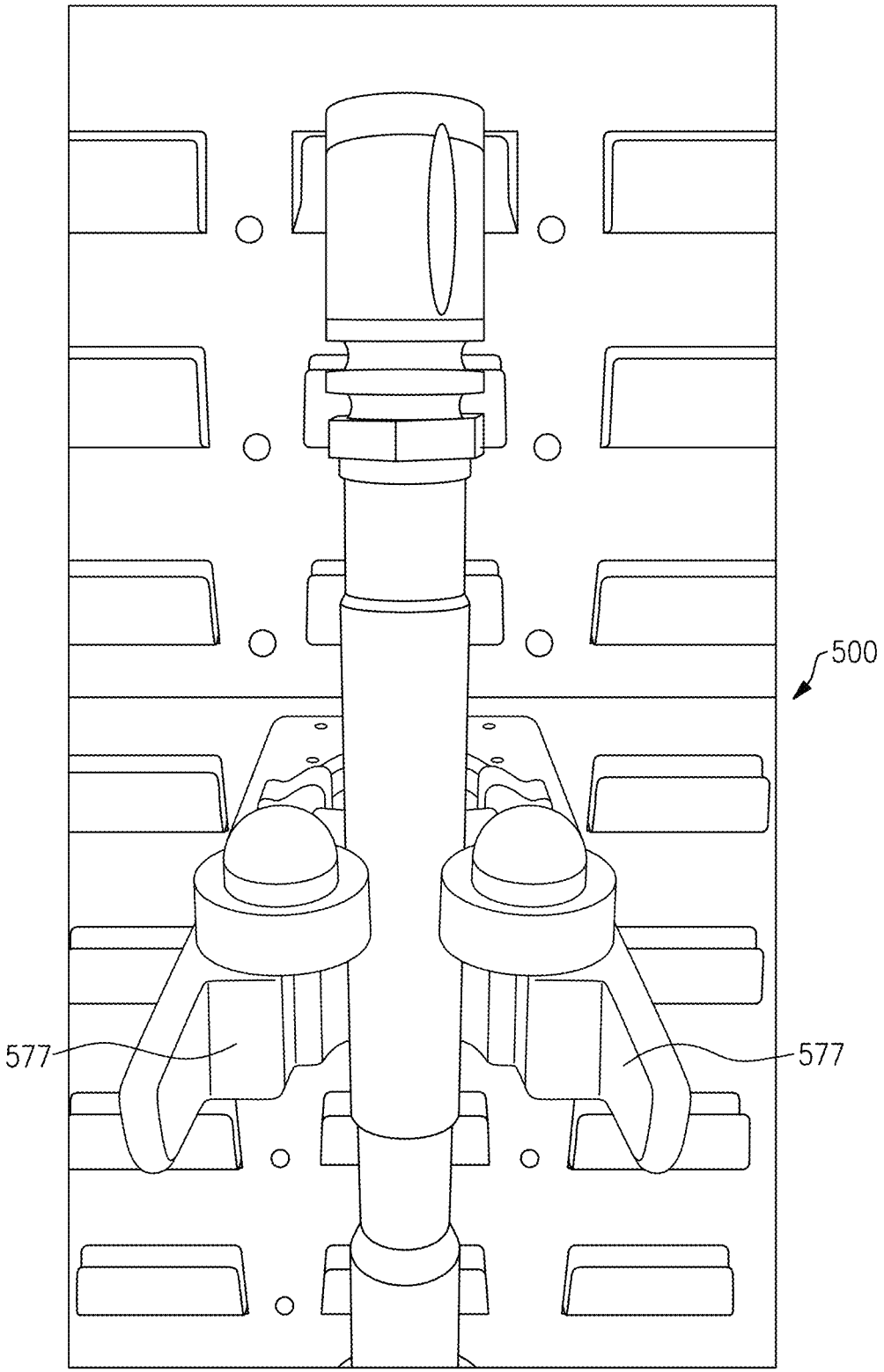
FIG. 5B is a drawing showing an elevated perspective view of the roller type locking upper saddle of FIG. 5A.

Smaller barrel weapons (e.g. AR-15): FIG. 5A and FIG. 5B show another exemplary roller type locking upper saddle such as is suitable for a smaller barrel weapon such as, for example, an AR-15 rifle. It was realized that a new wireform spring assembly 503 can replace the elastic cord to provide a roller type locking upper saddle 500 for smaller barrel firearms (i.e. spring steel with rollers vs. a bungee of the prior art). Now, the wireform spring assembly 503 can be disposed on a single surface of an upper saddle of any suitable thickness (typically, but not necessarily, thicker than the sheet metal of the first and second surfaces of the roller type locking upper saddle FIG. 2A to FIG. 2D.

FIG. 5A shows a top view of an exemplary roller type locking upper saddle 500, such as is suitable to secure an AR-15 to a wall of a weapon storage wall or weapon storage wall cabinet. The wireform spring assembly 503 is now formed in about one plane on a surface 505. The two spring arm shafts, one side shown as 503*d*, turn at about a right angle out of the plane as before (e.g. FIG. 2E). The exemplary wireform pattern of FIG. 5A follows about the cleat pattern of a prior art upper saddle that was initially intended to capture an elastic cord as was shown in FIG. 1. For simplicity, one side of the wireform spring assembly 503 is labeled in detail in FIG. 5A. The top section 503*h* wraps around a T cleat 563. From the top section 503*h* a connecting section 503*g* connects to a straight section 503*e* which passed under the left cleat 561 just before the turn section 503*b*, followed by the left spring arm 503*c*. The left spring arm 503*c* connects to the spring arm shaft 503*d* to which the roller 501 is rotatingly coupled and held in place by locking cap 525. Any suitable locking caps 525 can be used to rotatingly couple the pair of rollers to the spring arm shafts similar to the exemplary spring arm shafts 225 of FIG. 2A to FIG. 2D. Suitable locking caps include, for example, a press fit or threaded screw on cap can be used for locking cap 525.

FIG. 5B shows an elevated perspective view of the roller type locking upper saddle of FIG. 5A. The about U-shaped opening in a relatively thick single surfaced upper saddle can have additional openings, such as widening channels 577 (FIG. 5B) on either side of the U-shaped opening (to allow open space for accessory devices, couplers, or other attachments on the barrel).

For the exemplary roller type locking upper saddle FIG. 5A to FIG. 5D, the distance between the innermost surfaces of the pair or rollers varies from about 0.22 inches in a relaxed (no weapon) spring biased condition to about 1.0 inch where the barrel is passing through the rollers, either for securing the weapon in the roller type locking upper saddle of the weapon storage rack, or while removing the weapon for use. Those skilled in the art, will understand that these distances will vary for the types of barrels for which the upper saddle is intended.

Figure 5C:
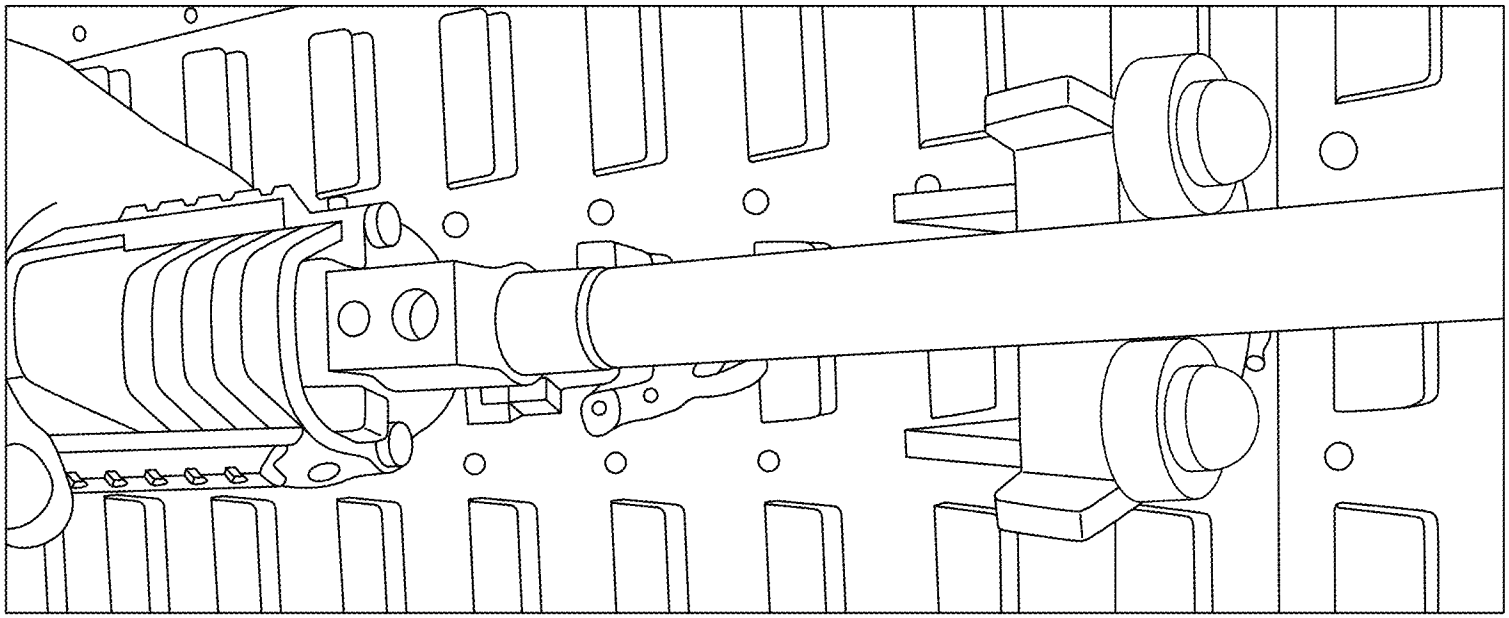
FIG. 5C is a drawing showing a rifle barrel being pushed into the upper saddle of FIG. 5A.
Figure 5D:
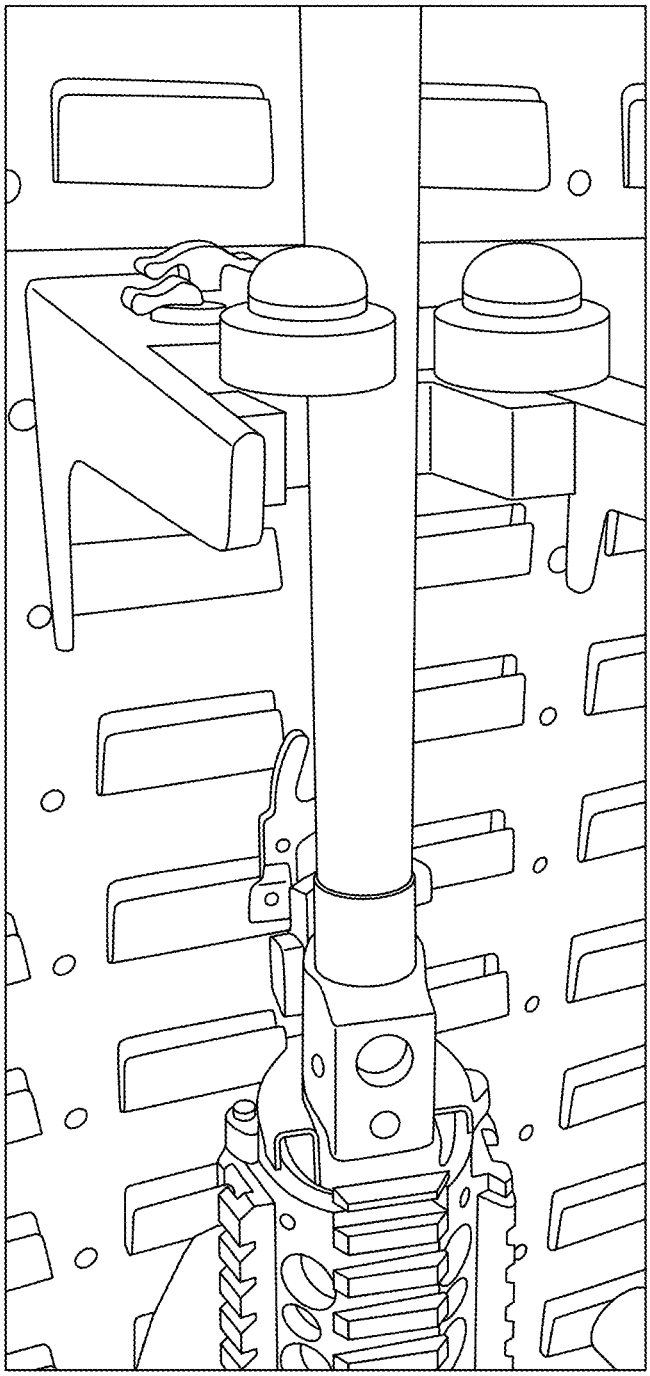
FIG. 5D is a drawing showing a rifle barrel secured in the upper saddle of FIG. 5A.

FIG. 5C shows a front view of the roller type locking upper saddle of FIG. 5A with a rifle barrel moving through the rollers. FIG. 5D shows a front view of the roller type locking upper saddle of FIG. 5A with a rifle barrel secured in the roller type locking upper saddle.

Rotating locks with elastic band—Another embodiment of a snap lock device for an upper saddle was realized using rotating locks with an elastic band that couples each of the pair of rotating locks to each other.

Figure 6A:
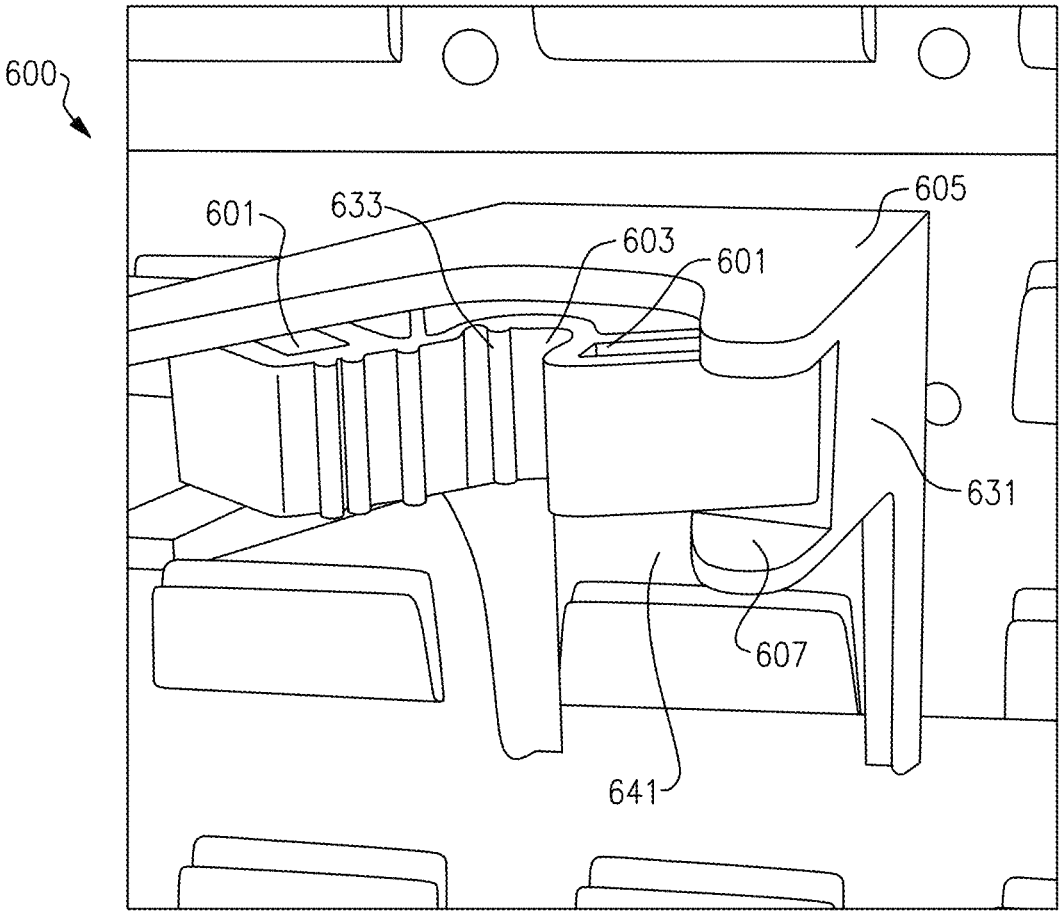
FIG. 6A is a drawing showing an upper saddle with rotating locks in a relaxed state.
Figure 6B:
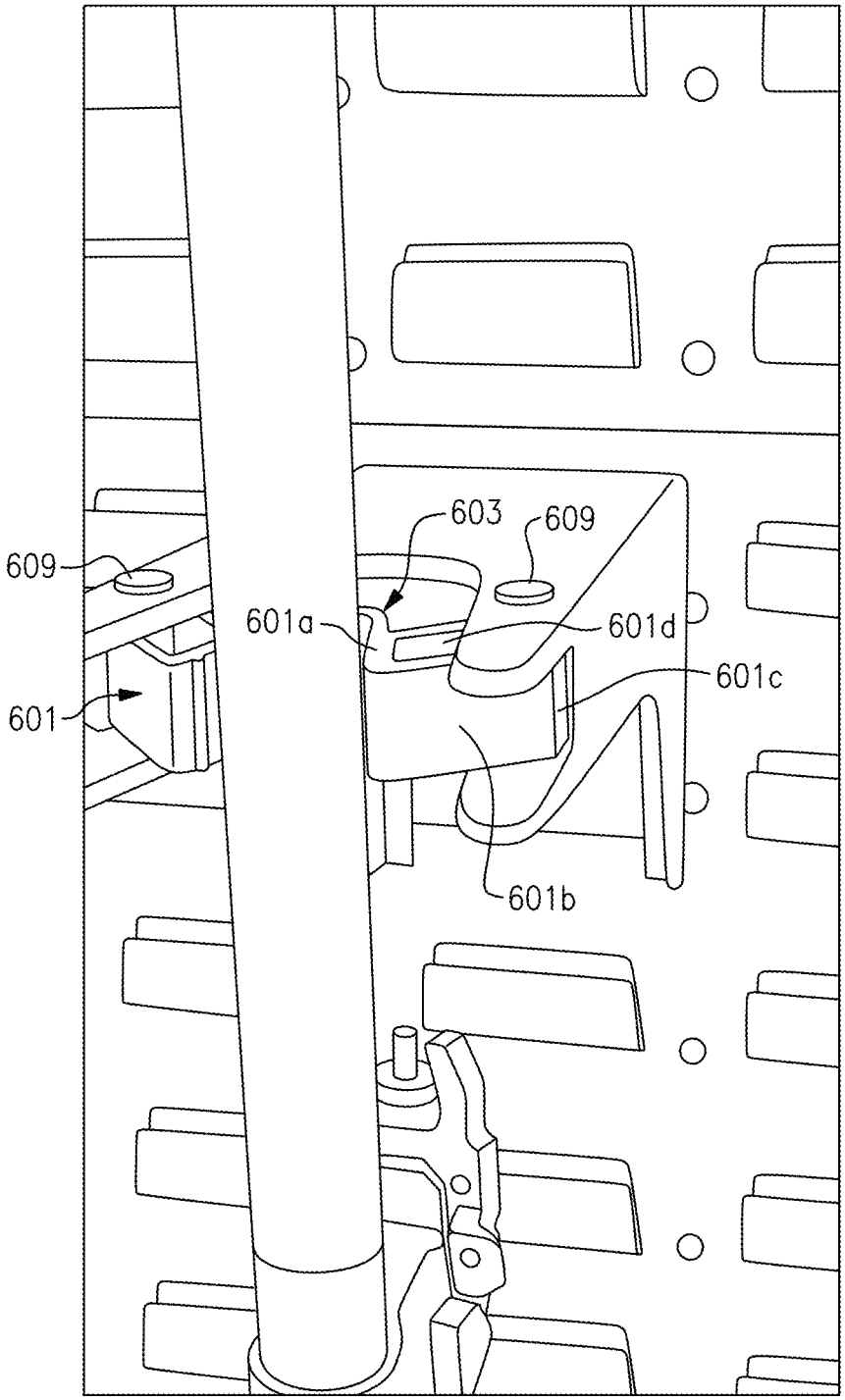
FIG. 6B is a drawing showing a barrel being pushed into an upper saddle with rotating locks.
Figure 6C:
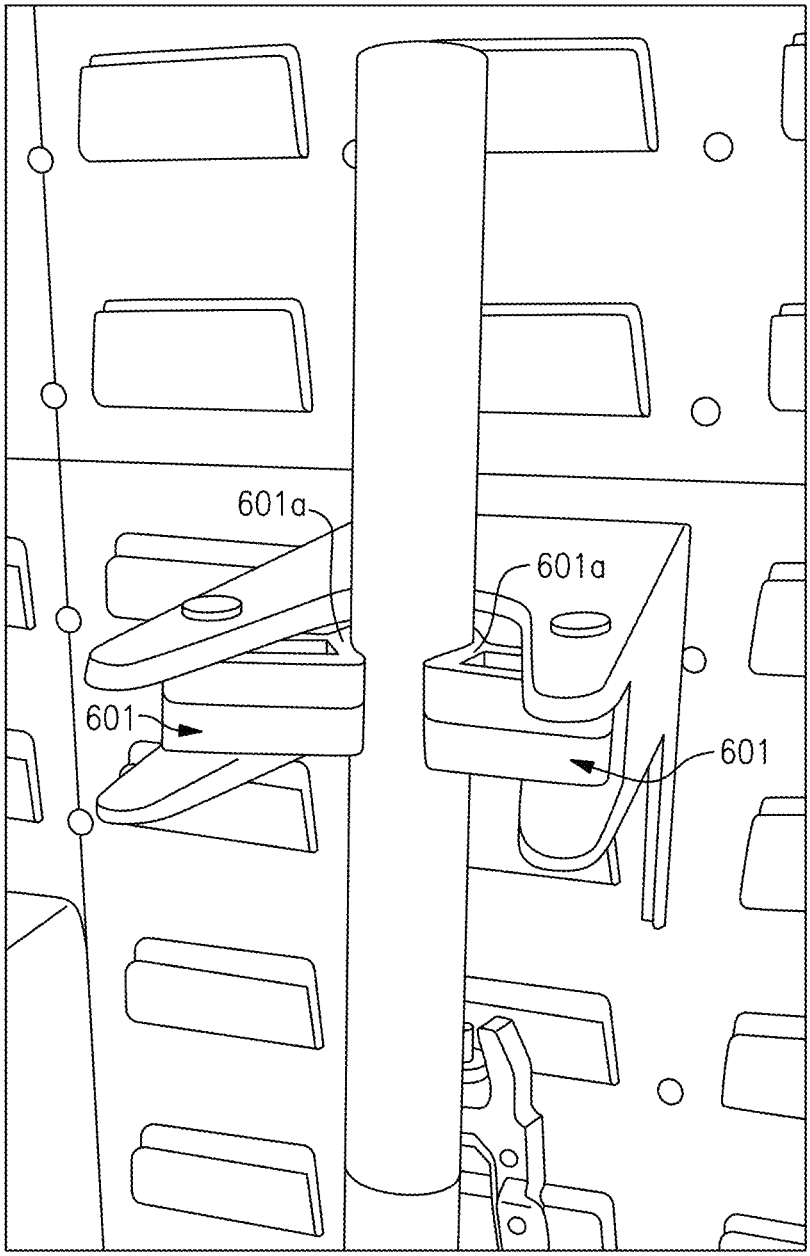
FIG. 6C is a drawing showing a barrel locked into an upper saddle with rotating locks.

FIG. 6A to FIG. 6C show drawings of one exemplary upper saddle with rotating locks 600.

FIG. 6A is a drawing showing an upper saddle with rotating locks 600 in a relaxed state. In the relaxed state, before a barrel is inserted and secured into the upper saddle 600 (a barrel "receiving" state) each of the rotating locks 601 is shown in an open position at a relaxed angle of between about 30 to 80 degrees with respect to the back surface or back wall of the weapon storage unit. The about U-shaped band 603 sets the relaxed angle.

Similar to upper saddles with snap lock mechanisms based on spring steel and rollers described herein above, there is a first upper saddle surface 605 and a second upper saddle surface 607. Each of the first upper saddle surface 605 and a second upper saddle surface 607 have an about U-shaped opening to accept the barrel of a firearm. The radius of curvature of curved band 603 varies as the rotating locks 601 rotate between the "barrel receiving" state to the "barrel locked state". The about U-shaped elastic band 603 and the rotating locks are disposed between the first surface 605 and the second surface 607.

In the exemplary upper saddle with rotating locks 600 of FIG. 6A to FIG. 6C, the first surface is mechanically coupled to and supported by each of two side walls 631 as well as a back wall 641 which also provides hook openings 683 and lower flange 685 which extends from the back surface 641 which accept any of the hooks 281 of the back wall of the weapon storage system. The exemplary first upper saddle surface 605 and a second upper saddle surface 607 of the drawings were machined from aluminum. Any suitable metal or plastic can be used. Each of the rotating locks 601 is rotatingly mounted by pins 609 (FIG. 6B). Any suitable fastener, pin, or shaft can be used.

FIG. 6B is a drawing showing a barrel being pushed into an upper saddle with rotating locks 601. In the exemplary upper saddle with rotating locks 600, each of the rotating locks 601 have four walls, 601*a*, 601*b*, 601*c*, and 601*d*, to make about a malleable or compressible rectangle or parallelogram.

There can optionally be ridges, lines 633 (FIG. 6A), grooves, troughs, dimples, or any suitable combination thereof, to increase friction or traction as the barrel is pushed in between the pair of rotating locks 601 to help grab both of the 601*a* surfaces about the outer surface of a barrel as the barrel is pushed into the upper saddle with rotating locks 600.

FIG. 6C is a drawing showing a barrel locked into an upper saddle with rotating locks 600 and thus secured in the weapon storage system. In the locked state, both rotating locks 601 are elastically held into a stable biased locked state by the now tensioned about U-shaped band 603. There may or may not be some deformation of the rotating locks 601 surfaces 601*a* about the barrel.

In the exemplary upper saddle with rotating locks 600 of FIG. 6A to FIG. 6C, the distance between the innermost edges 601*a* of the pair or rotating locks varies from about 1.25 inches in a relaxed (no weapon) spring biased condition to about 0.375 inches where the barrel is passing through the rotating locks, either for securing the weapon in the roller type locking upper saddle of the weapon storage rack, or while removing the weapon for use. Those skilled in the art, will understand that these distances will vary for the types of barrels for which the upper saddle is intended.

Figure 7A:
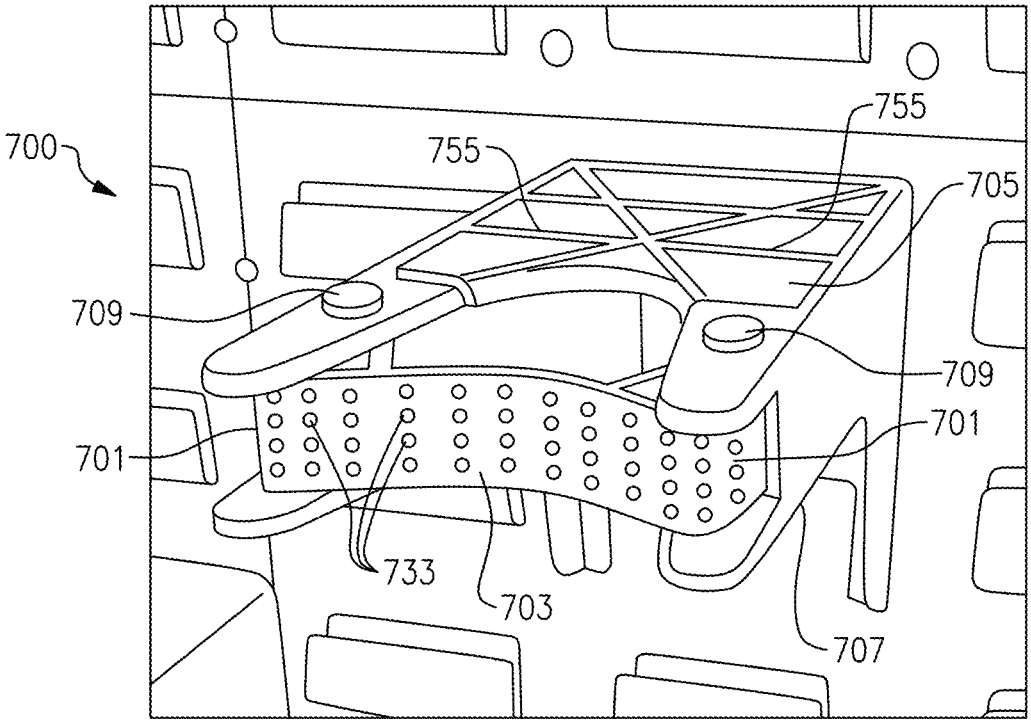
FIG. 7A is a drawing showing another upper saddle with rotating locks in a relaxed state.
Figure 7B:
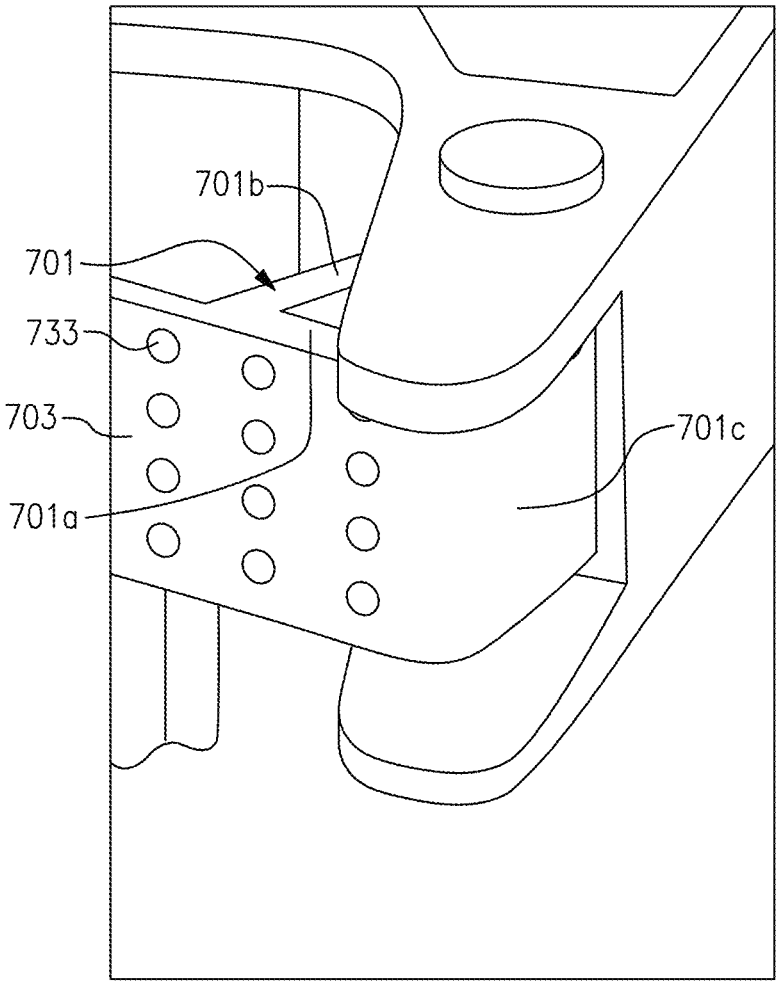
FIG. 7B is a drawing showing a barrel being pushed into an upper saddle with rotating locks of FIG. 7A.
Figure 7C:
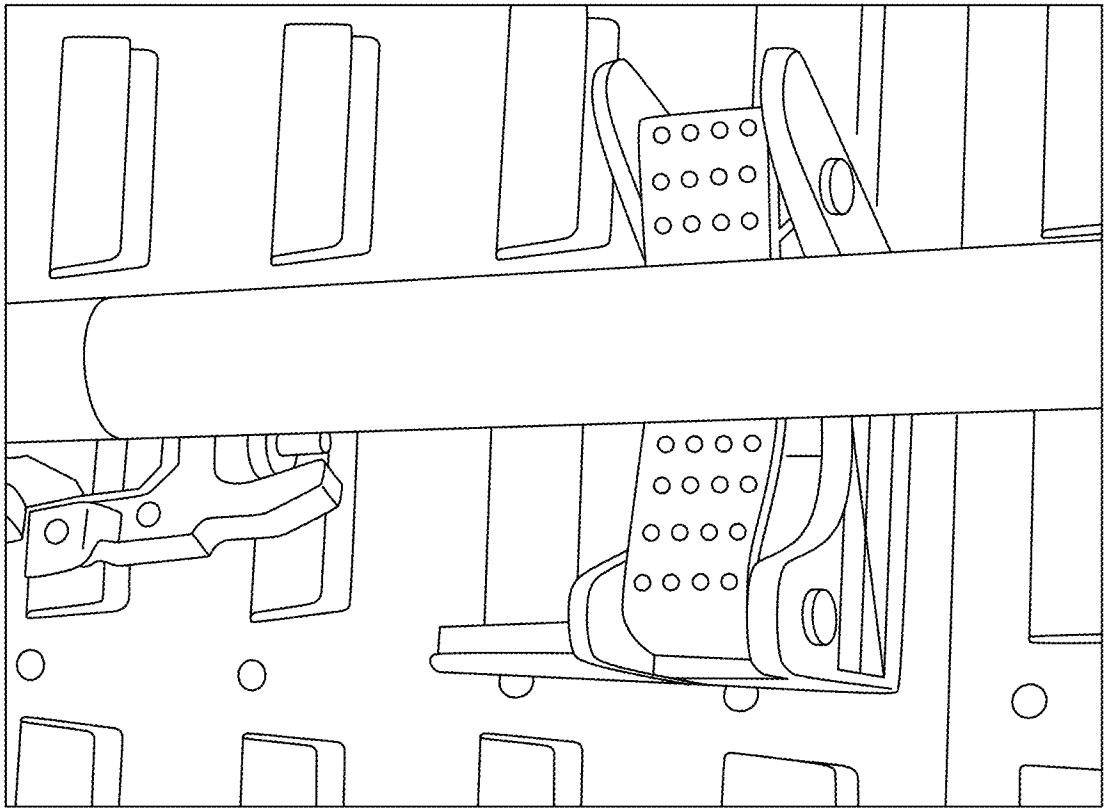
FIG. 7C is a drawing showing a barrel being pushed into an upper saddle with rotating locks of FIG. 7A.

FIG. 7A to FIG. 7C show drawings of another exemplary upper saddle with rotating locks 700.

FIG. 7A is a drawing showing an upper saddle with rotating locks 701 in a relaxed state. In the relaxed state, before a barrel is inserted and secured into the upper saddle 700 (a "barrel receiving" state) each of the rotating locks 701 is shown in an open position at a relaxed angle of about 10 to 80 degrees with respect to the back surface or back wall of the weapon storage unit. The curved band 703 sets the relaxed angle.

Similar to upper saddles with snap lock mechanisms based on spring steel and rollers described herein above, there is a first upper saddle surface 705 and a second upper saddle surface 707. Each of the first upper saddle surface 705 and a second upper saddle surface 707 have an about U-shaped opening to accept the barrel of a firearm. The radius of curvature of curved band 703 varies as the rotating locks 701 rotate between the "barrel receiving" state to the "barrel locked state". The curved band 703 and the rotating locks are disposed between the first surface 705 and the second surface 707.

In the exemplary upper saddle with rotating locks 700 of FIG. 7A to FIG. 7C, the first surface is mechanically coupled to and supported by each of two side walls 731 as well as a back wall 741 which also provides hook openings 783 and lower flange 785 which extends from the back surface 741 which accept any of the hooks 281 of the back wall of the weapon storage system. The exemplary first upper saddle surface 705 and a second upper saddle surface 707 of the drawings were form molded from plastic. Any suitable metal or plastic can be used. Where lighter materials, such as plastics, are used, there can also be strengthening ridges 755 to increase the rigidity and robustness or either or both of the first upper saddle surface 705 and a second upper saddle surface 707. Each of the rotating locks 701 is rotatingly mounted by pins 709. Any suitable fastener, pin, or shaft can be used for pins 709.

FIG. 7B is a drawing showing a barrel being pushed into an upper saddle with rotating locks 700. In the exemplary upper saddle with rotating locks 700, each of the rotating locks 701 have three walls, 701*a*, 701*b*, and 701*c* (FIG. 7B) to make about a malleable or compressible triangle. Here, the curved band 703 is an extension of, and shares in common with both of the walls 701*a*. Any suitable rectangle or parallelogram with four walls as described hereinabove can also be used.

There can optionally be ridges, lines, grooves, troughs, dimples 733, or any suitable combination thereof, to increase friction or traction as the barrel is pushed in between the pair of rotating locks 701 to help grab both of the 701*a* surfaces about the outer surface of a barrel as the barrel is pushed into the upper saddle with rotating locks 700.

FIG. 7C is a drawing showing a barrel being pushed into an upper saddle with rotating locks 700.

Figure 7D:
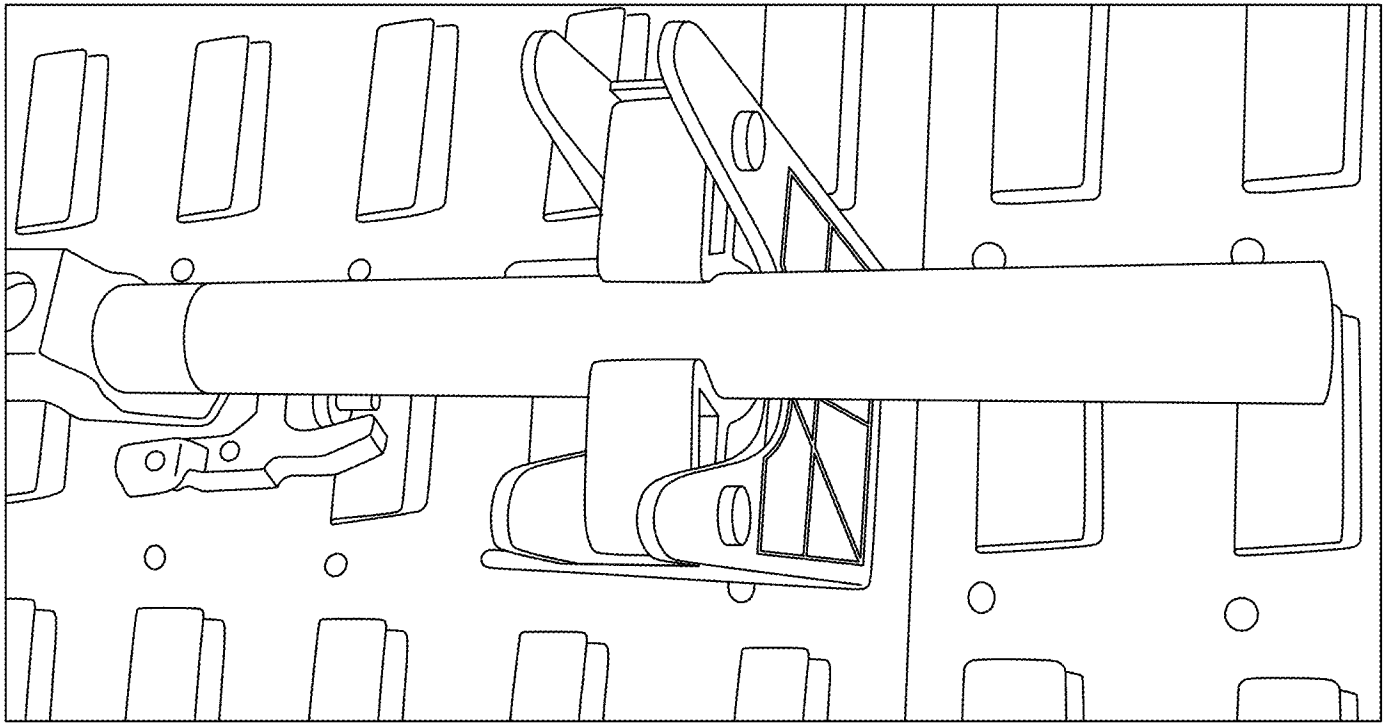
FIG. 7D is a drawing showing a barrel locked and secured into an upper saddle with rotating locks.

FIG. 7D is a drawing showing a barrel locked into an upper saddle with rotating locks 701 and thus secured in the weapon storage system. In the locked state, both rotating locks 701 are elastically held into a stable biased locked state by the now tensioned curved band 703. There may or may not be some deformation of the rotating locks 701 surfaces 701*a* about the barrel.

In the exemplary upper saddle with rotating locks 700 of FIG. 7A to FIG. 7C, the distance between the innermost edges 701*a* of the pair or rotating locks varies from about 1.75 inches in a relaxed (no weapon) spring biased condition to about 0.625 inches where the barrel is passing through the rotating locks, either for securing the weapon in the roller type locking upper saddle of the weapon storage rack, or while removing the weapon for use. Those skilled in the art, will understand that these distances will vary for the types of barrels for which the upper saddle is intended.

It is only important that a roller or rotating lock be spring biased into at least one of an open or empty position without a barrel, or a secured position where the barrel is locked into the upper saddle. Typically, for example, a roller type upper saddle is spring biased into the barrel locked position by a wire spring (i.e. spring biased to move the rollers closer to each other in about a plane perpendicular to the rotational axis of each of the rollers).

However, particularly in a rotating lock and band upper saddle, a combination of a cam action of the rotating locks and the band elastic element can cause the pair of rotating locks to spring bias towards both of the open and the barrel capture positions. The cam action is defined as any rotating roller or more typically a rotating lock where the hole is off center from a center of diameter or center or perimeter (e.g. center of area of the rotating part about in a plane perpendicular to the axis of rotation) of the roller or rotating lock.

The cam action can cause a spring biased upper saddle to be spring biased in both of the weapon out and weapon secured positions. For example, a band and rotating lock upper saddle can be relatively lightly spring biased to an open position to accept a barrel by the band. That is, the open surfaces of the rotating locks are in a position to accept the barrel of a weapon, without need to first manual adjust them into a barrel accepting rotational position. Then, because of the cam action of the rotating locks, once the barrel is snap locked into the upper saddle, now the same band also spring biases the rotating locks into the locked position securely holding the barrel into the upper saddle.

Any suitable weapon storage system and method can be used to mount the new snap lock upper saddles of the Application to a wall of a weapon storage system. The weapon storage system hook type mounts which accept the new snap lock upper saddle of the Application merely describe examples of how an upper saddle can be mounted to a back wall of a weapon storage system (e.g. a weapon cabinet). Typically, such walls are about vertical, however the snap lock upper saddles of the Application can also be mounted at any suitable angle with respect to a ground or floor surface, including a horizontal storage system where the "wall" is a flat surface about parallel to the ground or floor.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. An upper saddle of a weapon storage rack for securing a barrel of a firearm comprising:

an upper saddle body with a pair of about U-shaped openings adapted to accept and cradle the barrel of the firearm, said pair of about U-shaped opening including a first forward facing about U shaped opening disposed in an upper surface of a bracket and a second first forward facing about U shaped opening disposed in a lower surface of said bracket, said upper surface and said lower surface joined by a front surface, said bracket mechanically coupled to a back surface of said upper saddle body; and a pair of snap locks disposed in or on said upper saddle, said pair of snap locks including a left snap lock and a right snap lock, said pair of snap locks comprising a pair of rollers spring biased by a wireform spring to a closed position, said wireform spring mechanically coupled to said back surface of said upper saddle body, said wireform spring comprising at least a pair of spring arms, each spring arm having an about right angle spring arm shaft at an end of each spring arm, and a roller of said pair of rollers rotatingly coupled to each of said about right angle spring arm shafts, said rollers configured to lock the barrel of the firearm into said about U-shaped opening; and wherein said front surface disposed forward of said pair of rollers.

2. The upper saddle of claim 1, wherein in a first configuration where without the barrel disposed in said upper saddle body, or with the barrel snapped in, a distance between a right most extent of said left snap lock and a left most extent of said right snap lock is less than a diameter of the barrel of the firearm to be secured in a weapon rack.

3. The upper saddle of claim 2, wherein said pair of snap locks comprises said pair of rollers, each roller rotatingly coupled to a pin which extends from an end of a spring element which spring element spring biases both of said rollers to said first configuration.

4. The upper saddle of claim 1, wherein in a second configuration, distance between a right most extent of said left snap lock and a left most extent of said right snap lock is equal to or greater than the barrel of the firearm as the barrel passes into an upper saddle barrel locked state.

5. The upper saddle of claim 1, wherein said spring element is secured to a top surface of said upper saddle body.

6. The upper saddle of claim 1, wherein said spring element comprises a wire spring secured to said upper saddle body by at least one cleat.

7. The upper saddle of claim 1, wherein said spring element comprises a wire spring secured to said upper saddle body by a center T cleat and a left and a right L cleat.

8. The upper saddle of claim 1, wherein said bracket comprises a first surface having said about U-shaped opening and a second surface having about said about U-shaped opening and a front surface.

9. The upper saddle of claim 1, wherein said pair of rollers is disposed between a first surface and a second surface of said upper saddle.

10. The upper saddle of claim 9, wherein said spring element is mechanically coupled to a back surface of said upper saddle.

11. The upper saddle of claim 1, wherein at least one of said forward facing about U shaped openings further comprises a protective U-channel to prevent scratching or marring of a surface of the barrel of the firearm.

12. The upper saddle of claim 8, wherein said front surface of said bracket comprises a marking designating a type of firearm for which said upper saddle is sized.

13. An upper saddle of a weapon storage rack for securing a barrel of a firearm comprising:

an upper saddle body with an about U-shaped opening adapted to accept the barrel of the firearm; and a pair of snap locks disposed in or on said upper saddle, said pair of snap locks including a left snap lock and a right snap lock, said pair of snap locks comprising a pair of rollers spring biased by a spring to at least a spring biased open or a spring biased closed position;

wherein said pair of snap locks comprises said pair of rollers, each roller rotatingly coupled to a pin which extends from an end of a spring element which spring element spring biases both of said rollers towards a barrel capture position; and wherein said spring element comprises a wire spring secured to said upper saddle body by a center T cleat and a left and a right L cleat.

* * * * *